US011724207B2

(12) United States Patent
Zavracky

(10) Patent No.: US 11,724,207 B2
(45) Date of Patent: Aug. 15, 2023

(54) ADJUSTABLE COUNTERWEIGHT FOR A ROTATABLE PERFORMANCE DEVICE

(71) Applicant: Flambeau, Inc., Baraboo, WI (US)

(72) Inventor: Richard Zavracky, Middlefield, OH (US)

(73) Assignee: FLAMBEAU, INC., Baraboo, WI (US)

( * ) Notice: Subject to any disclaimer, the term of this patent is extended or adjusted under 35 U.S.C. 154(b) by 490 days.

(21) Appl. No.: 16/800,133

(22) Filed: Feb. 25, 2020

(65) Prior Publication Data

US 2020/0269148 A1 Aug. 27, 2020

Related U.S. Application Data

(60) Provisional application No. 62/810,693, filed on Feb. 26, 2019.

(51) Int. Cl.
*A63H 1/30* (2006.01)

(52) U.S. Cl.
CPC ..... *A63H 1/30* (2013.01)

(58) Field of Classification Search
CPC ..... A63H 1/30; A63H 3/003
USPC ..... 446/247, 248, 249, 250, 251, 252, 253, 446/254
See application file for complete search history.

(56) References Cited

U.S. PATENT DOCUMENTS 265,207 A * 9/1882 Wurst ..... A63H 1/30 446/265
1,806,485 A * 5/1931 Mirafuentes ..... A63H 1/28 446/265
1,851,769 A * 3/1932 Hutchinson ..... A63H 1/32 446/253
1,854,876 A * 4/1932 Anzalone ..... A63H 1/32 446/253
1,923,019 A * 8/1933 De Silva ..... A63H 1/30 473/506
1,949,858 A * 3/1934 Brown ..... A63H 33/36 446/250
2,161,154 A * 6/1939 Gertler ..... A63H 1/32 446/253
2,247,315 A * 6/1941 Singer ..... A63H 1/30 446/265
2,364,821 A * 12/1944 Ruthven ..... A63H 33/20 446/49
2,375,844 A * 5/1945 Grossman ..... A63H 33/20 446/53
2,412,519 A * 12/1946 Kuhn ..... A63H 1/32 446/253
2,610,439 A * 9/1952 Nemeth ..... A63H 1/30 446/261
2,676,432 A * 4/1954 Field ..... A63H 1/30 446/315
2,992,510 A * 7/1961 Grangood ..... A63H 1/32 446/253

(Continued)

*Primary Examiner* — Joseph B Baldori
(74) *Attorney, Agent, or Firm* — Quarles & Brady LLP

(57) ABSTRACT

An adjustable counterweight for a yo-yo allows for the addition or subtraction of weight plates in a midsection of the counterweight assembly. The counterweight includes a first portion having at least one post, a second portion having at least one post, at least one weight plate having at least one aperture, and a bore that extends through the first portion and the second portion, and is configured to receive a fastener. The at least one weight plate is disposed between the first portion and the second portion.

18 Claims, 19 Drawing Sheets

(56) References Cited

U.S. PATENT DOCUMENTS 3,081,578 A * 3/1963 Mosher ..... A63H 1/30 446/251
3,936,974 A * 2/1976 House ..... A63H 1/30 446/250
4,318,243 A * 3/1982 MacCarthy ..... A63H 1/30 446/250
4,438,727 A * 3/1984 Thompson ..... A01K 15/025 446/227
4,878,868 A * 11/1989 Shaw ..... A63B 67/10 473/576
5,017,172 A * 5/1991 Seifert ..... A63H 1/30 446/259
5,116,106 A * 5/1992 Hardesty ..... B60B 15/28 301/53.5
RE34,208 E * 3/1993 Shaw ..... A63B 67/10 446/75
5,254,027 A * 10/1993 McAvoy, Jr. ..... A63H 1/30 446/250
5,356,328 A * 10/1994 Ho ..... A63H 1/24 446/253
5,389,029 A * 2/1995 McAvoy, Jr. ..... A63H 1/30 446/253
5,779,604 A * 7/1998 Towley, III ..... A63B 21/0728 482/107
5,813,898 A * 9/1998 Van Dan Elzen ..... A63H 1/30 446/250
5,947,790 A * 9/1999 Gordon ..... B65H 75/4486 242/390.8
5,951,353 A * 9/1999 Moore ..... A63H 33/18 446/5
6,017,296 A * 1/2000 Tang ..... A63B 22/20 482/907
6,120,342 A * 9/2000 Chan ..... A63H 1/32 446/254
6,123,596 A * 9/2000 Hsu ..... A63H 1/30 446/250
6,146,233 A * 11/2000 Hedeen, Jr. ..... A63H 1/04 446/259
6,196,891 B1 * 3/2001 Jamison ..... A63H 1/30 446/250
6,220,920 B1 * 4/2001 Baier ..... A63H 1/30 446/249
6,283,556 B1 * 9/2001 Taylor ..... B60B 15/28 301/53.5
6,332,851 B1 * 12/2001 Griffin ..... A63B 67/10 473/576
6,371,824 B1 * 4/2002 Brown ..... A63H 1/30 446/250
6,561,867 B1 * 5/2003 Rehkemper ..... A63H 1/30 446/396
6,579,142 B1 * 6/2003 Rehkemper ..... A63H 1/30 446/250
6,629,873 B2 * 10/2003 Shaw ..... A63B 67/10 446/490
6,780,144 B2 * 8/2004 Stevens ..... A63B 21/0602 482/50
6,896,578 B2 * 5/2005 Shaw ..... A63H 33/18 473/576
7,011,611 B1 * 3/2006 Ripley ..... A63B 21/0728 482/107
7,125,310 B1 * 10/2006 Van Dan Elzen ..... A63H 1/30 446/250
7,137,863 B2 * 11/2006 Hiebert ..... A63B 67/16 446/490
7,874,891 B2 * 1/2011 Van Dan Elzen ..... A63H 1/30 446/236
8,167,380 B2 * 5/2012 Eaton ..... B60B 15/28 301/64.203
8,360,814 B2 * 1/2013 Van Dan Elzen ..... A63H 1/30 446/250
9,004,978 B2 * 4/2015 Shaw ..... A63B 67/08 446/490
9,079,112 B2 * 7/2015 Hasegawa ..... A63H 1/30
9,345,984 B2 * 5/2016 White ..... A63H 33/18
9,782,685 B1 * 10/2017 Perez ..... A63H 1/32
9,839,858 B1 * 12/2017 Perez ..... B65D 51/28
9,914,063 B1 * 3/2018 McCoskery ..... A63F 9/16
9,987,539 B2 * 6/2018 Shaw ..... A63B 67/10
10,322,327 B2 * 6/2019 Shaw ..... A63F 7/28
10,722,808 B2 * 7/2020 Jardin ..... A63H 1/30
10,807,410 B2 * 10/2020 Letscher ..... B62D 49/0628
10,899,170 B2 * 1/2021 Letscher ..... B60B 15/28
11,065,520 B1 * 7/2021 Nguyen ..... A63B 67/10
D928,240 S * 8/2021 Zavracky ..... A63H 1/30 D21/499
2004/0198151 A1 * 10/2004 Bell ..... A63H 1/30 446/247
2004/0198174 A1 * 10/2004 Shaw ..... A63H 33/18 446/490
2007/0224910 A1 * 9/2007 Schonert ..... A63H 1/30 446/250
2009/0258568 A1 * 10/2009 Hochstrasser ..... A63H 1/30 446/250
2014/0017973 A1 * 1/2014 Lin ..... A63H 1/30 446/250
2019/0105577 A1 * 4/2019 Jardin ..... A63H 1/30
2020/0269107 A1 * 8/2020 Whiting ..... A63B 21/075
2020/0269148 A1 * 8/2020 Zavracky ..... A63H 1/30
2022/0001289 A1 * 1/2022 Jardin ..... G01P 3/68

* cited by examiner

ADJUSTABLE COUNTERWEIGHT FOR A ROTATABLE PERFORMANCE DEVICE

CROSS-REFERENCE TO RELATED APPLICATIONS

This application claims priority to U.S. Provisional Application No. 62/810,693, filed on Feb. 26, 2019, and entitled "Adjustable Counterweight for a Rotatable Performance Device," which is hereby incorporated by reference in its entirety.

BACKGROUND

1. Field of the Disclosure

The present disclosure relates to adjustable counterweights for rotatable performance devices. More specifically, the disclosure relates to a counterweight for a yo-yo that includes multiple weight plates and that is selectively configurable to vary "play" characteristics of the device.

2. Description of the Background of the Disclosure

Rotatable performance devices, such as diabolos, yo-yos, and the like, are well-known entertainment devices for performing maneuvers or tricks. Yo-yos include a string that engages an axle of the device, and the string is initially wound around an axle and connected to a user's finger. The yo-yo is "thrown down" to cause two halves or lobes of the yo-yo to spin relative to the string. After the lobes begin spinning or "sleeping" at the end of the string, the user may perform maneuvers such as "walking the dog," swinging the yo-yo "around the world," and the like.

Attaching a solid body to act as a counterweight to a portion of the string enables the user to perform additional maneuvers or tricks. Maneuvers such as supporting the yo-yo by supporting the string between the solid body and the yo-yo while moving the yo-yo with respect to the support point are possible. Additionally, the counterweight may be attached to an end of the string onto which the user's finger would usually grasp. It is often desirable for a user to work with multiple different yo-yos of varying weights, sizes, and capabilities. The size of the counterweight is often proportional to the weight of the yo-yo used, where a heavier yo-yo would require a heavier counterweight.

However, traditional counterweights are of fixed weights. Thus, a user desiring to increase or decrease the weight of a counterweight typically needs to purchase multiple counterweights and attach or remove them incrementally. This can result in a variety of issues, including increased surface area of the string interfacing with counterweights, increased expense in obtaining multiple counterweights, limited ranges of weights available, limited increments of weights available, or increased time spent removing or attaching counterweights.

SUMMARY

In one aspect, a counterweight for a rotatable performance device includes a first portion, a second portion that is configured to be assembled with the first portion, a groove formed on the first portion and the second portion, and a bore configured to receive a fastener. The groove is configured to receive a portion of a string. The bore can be centrally located on each of the first and second portions. The groove can extend along three sides of the first portion. Further, the groove can extend along three sides of the second portion. The groove of the first portion may be configured to align with the groove of the second portion.

In some examples, the first portion may further comprise a top surface, a channel extending through the top surface, and a plurality of posts protruding from the top surface. The second portion may further comprise a bottom surface, a key extending from the bottom surface, and a plurality of posts extending from the bottom surface. The at least one weight plate can be configured to be received between the first and second portions.

In another aspect, a counterweight for a rotatable performance device comprises a first portion having at least one post, a second portion having at least one post, at least one weight plate having at least one aperture, and a bore configured to receive a fastener. The at least one weight plate can be disposed between the first portion and the second portion in an assembled state. The at least one aperture of the weight plate may be configured to receive the at least one post of the first portion or the second portion.

In some examples, the first portion further comprises a first inner surface, a central wall extending from the first inner surface and defining a channel, a chamber disposed within the channel, and a groove extending along a first side. The second portion can further comprise a second inner surface, a key extending from the second inner surface, wherein the key includes at least one end wall, and a groove extending along a second side. The channel of the first portion can receive the key of the second portion in an assembled state. A groove formed on the first portion aligns with a groove formed on the second portion.

In still another aspect, a counterweight comprises a first portion including a first groove, a second portion including a second groove that is arranged to be coupled with the first groove, and at least one weight plate having a recessed surface defining at least one aperture. The at least one weight plate is selectively engaged with the first portion and the second portion. The first groove and the second groove can be configured to receive a string. In some examples, a bore extends through the first portion, the second portion, and the weight plate. The bore can be configured to receive a bolt and a nut. In some examples, the first portion includes a first plurality of posts arranged on a top surface and the second portion includes a second plurality of posts arranged on a bottom surface. The recessed surface of the at least one weight plate can be selectively configurable to contact the first plurality of posts or the second plurality of posts.

In some examples, an adjustable counterweight for a yo-yo can enable the addition or subtraction of weight plates in a midsection of the counterweight assembly. The addition of weight plates increases the overall weight of the assembly by a predetermined amount at a level desired by the user. The subtraction of weight plates performs a similar function, but in reverse. It is further contemplated that the weight plates may be of varying sizes, shapes, and weights. The adjustment of weight enables a user to perform various maneuvers quickly and easily during use. A user may be able to finely tune the weight adjustment of the counterweight using washers in addition to weight plates.

The adjustable counterweight attaches to an end of a string for a yo-yo through a loop. The loop is tied and fitted about the adjustable counterweight prior to use. The adjustable counterweight is then held and manipulated by the user to perform various maneuvers or tricks during use with a broad spectrum of yo-yos. For example, a user operating a lightweight yo-yo may desire a lightweight counterweight. The user may reduce the weight of the adjustable counterweight by removing weight plates or washers. In this way, the adjustable counterweight eliminates the need to purchase multiple counterweights of varying sizes and configurations. Further, a user may change to a heavier weight yo-yo and may increase the adjustable counterweight's weight accordingly. Thus, the user realizes both time and cost benefits by leveraging the selectively configurable weight range offered by the adjustable counterweight. Further, the user is able to more comfortably expand his or her skills by performing with a broad spectrum of yo-yos using the same adjustable counterweight.

The exterior of the adjustable counterweight, in some embodiments, may be ergonomically designed to allow a user to perform various maneuvers and tricks for extended periods of time. While the exterior of the adjustable counterweight is typically smooth in texture to promote advantageous interaction with the string, a user may desire to affix stickers or fasteners to the surface for continued use and varied performance. In addition, the surface of the adjustable counterweight may be selectively customized to reflect a user's personality, a commercial brand or advertisement, or a visual performance aspect desired during use. Alternatively, some embodiments of the adjustable counterweight may involve differing textures or shapes to achieve a broader range of functionality or customization during use.

DETAILED DESCRIPTION

Before any examples are explained in detail, it is to be understood that the disclosure is not limited in its application to the details of construction and the arrangement of components set forth in the following description or illustrated in the following drawings. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "attached," "supported," and "coupled" and variations thereof are used broadly and encompass both direct and indirect mountings, connections, supports, and couplings. Further, "attached" and "coupled" are not restricted to physical or mechanical attachments or couplings.

Figure 1:
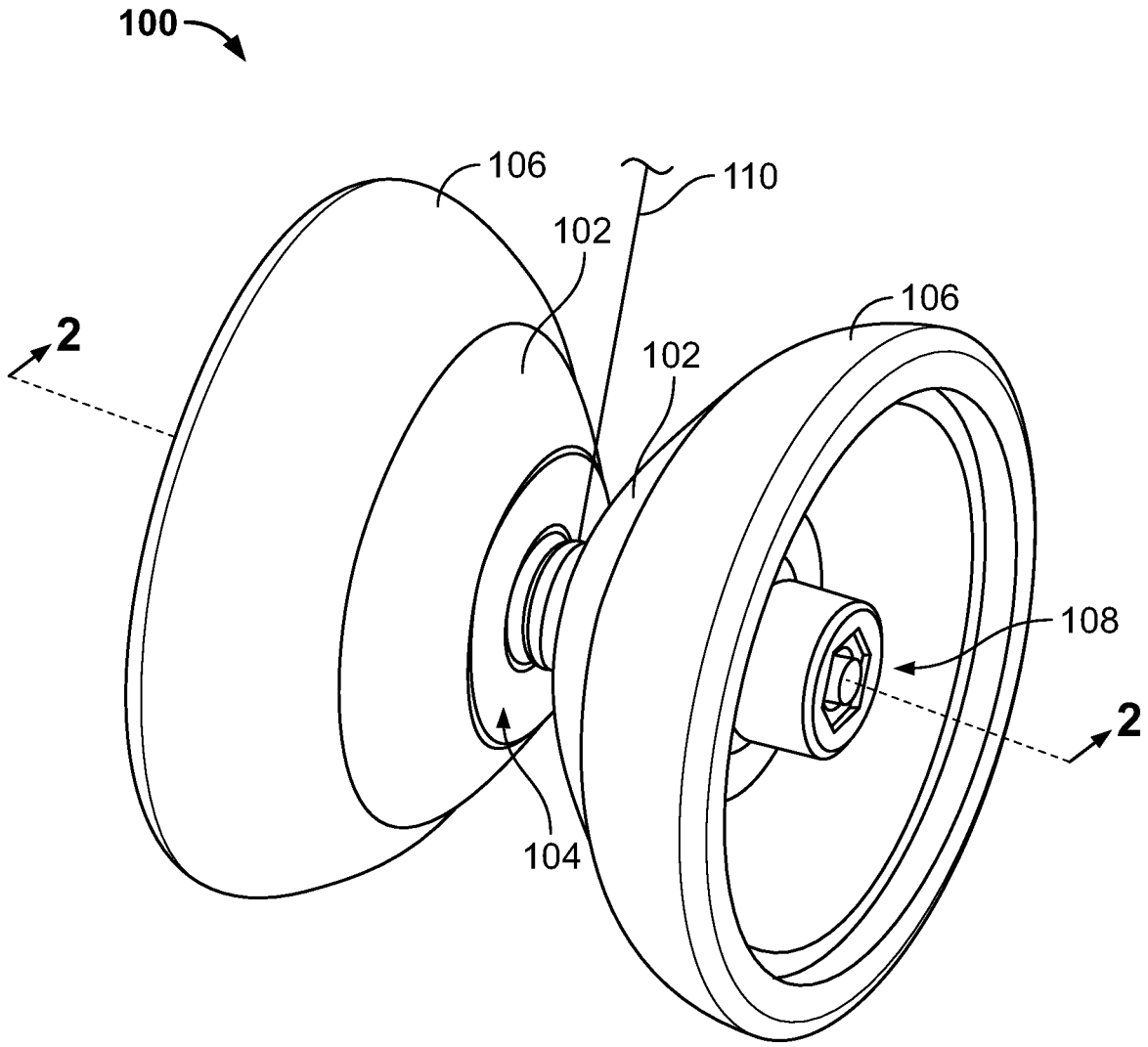
FIG. 1 is an isometric view of an exemplary rotatable performance device.
Figure 2:
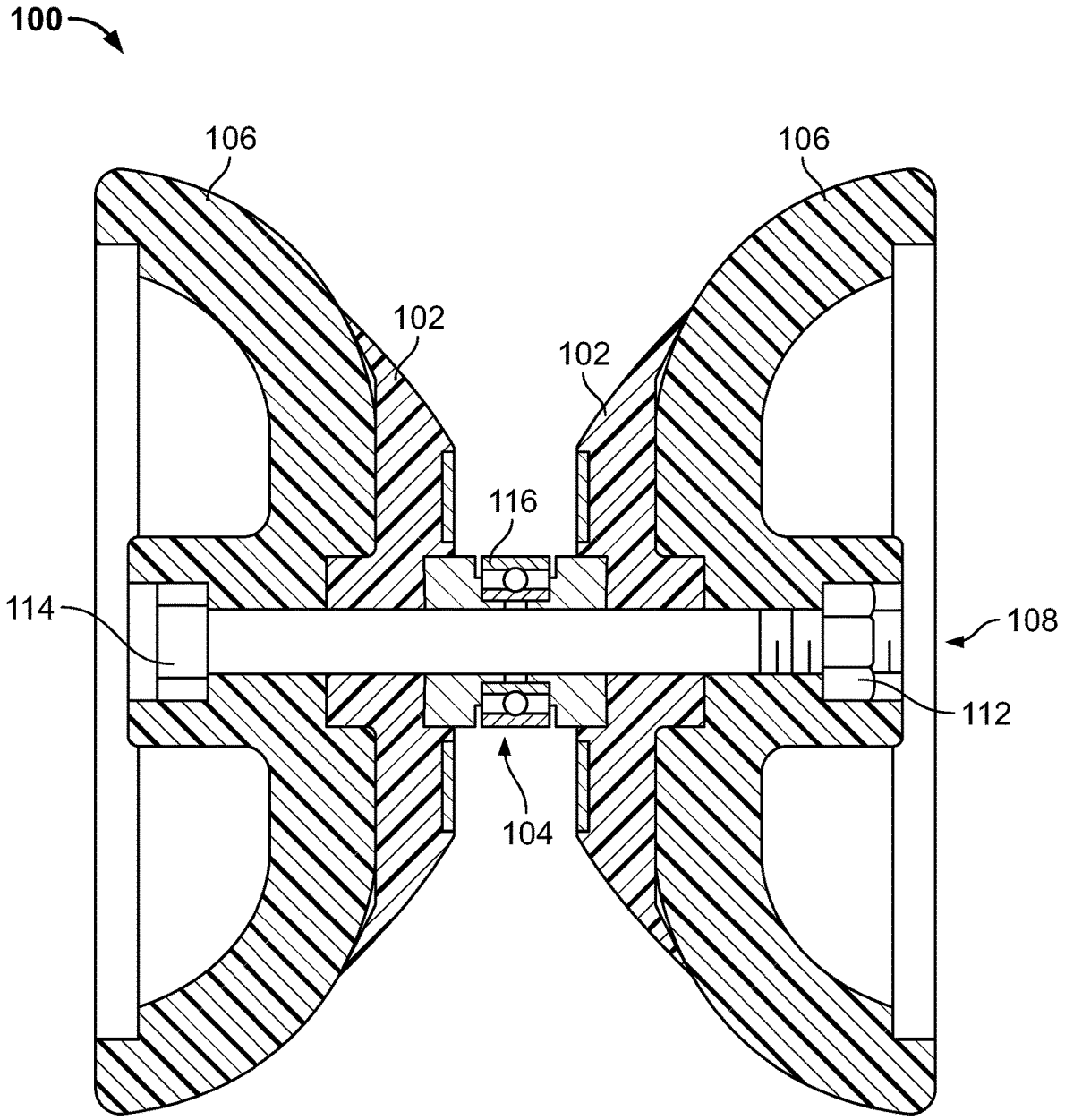
FIG. 2 is a cross-sectional view of the rotatable performance device taken along line 2-2 of FIG. 1.

Referring specifically to FIGS. 1 and 2, an example of a rotatable performance device or yo-yo 100 is depicted. In particular, the yo-yo 100 includes inner lobe spacers 102 that are attachable to and detachable from a bearing assembly 104, and are further attachable to and detachable from rotatable outer lobes 106. The yo-yo 100 includes an axle 108 that supports the above components and provides an axis about which some components of the yo-yo 100 rotate relative to a support tether or a string 110. In the example shown in FIGS. 1 and 2, the axle 108 includes a nut 112 and a threaded bolt 114. The nut 112 may be inset within a cavity, as depicted in FIG. 2.

Still referring to FIG. 2, the axle 108 supports the bearing assembly 104 along the shaft of the bolt 114. In general, the bearing assembly 104 permits relative rotation between some components of the yo-yo 100 and the string 110. To that end, the bearing assembly 104 includes a support bearing 116, which may be any appropriate type of bearing, such as a ball bearing. The string 110 is coupled to the support bearing 116 to permit the rotating portions of the yo-yo 100 to rotate during use while an outer portion of the support bearing 116 remains stationary relative to the string 110. The yo-yo 100 is assembled such that the bolt 114 is passed into a cavity defined by one of the outer lobes 106, one of the inner lobe spacers 102, the bearing assembly 104, the other of the inner lobe spacers 102, and the other of the outer lobes 106. The string 110 may be attached during assembly or may be tied onto the bearing assembly 104 once the yo-yo 100 has been assembled. The nut 112 is attached to the bolt 114 thereby completing the assembly.

It is contemplated that one having ordinary skill in the art would understand that many configurations are possible beyond the example yo-yo 100 depicted in FIGS. 1 and 2. Other contemplated yo-yos include a body having a central channel and an axle for attaching a string in the channel. The body is designed to rotate relative to the attachment of the string for the yo-yo to operate. It is also contemplated that the examples of adjustable counterweights disclosed herein can function with different rotatable performance device configurations.

Figure 3:
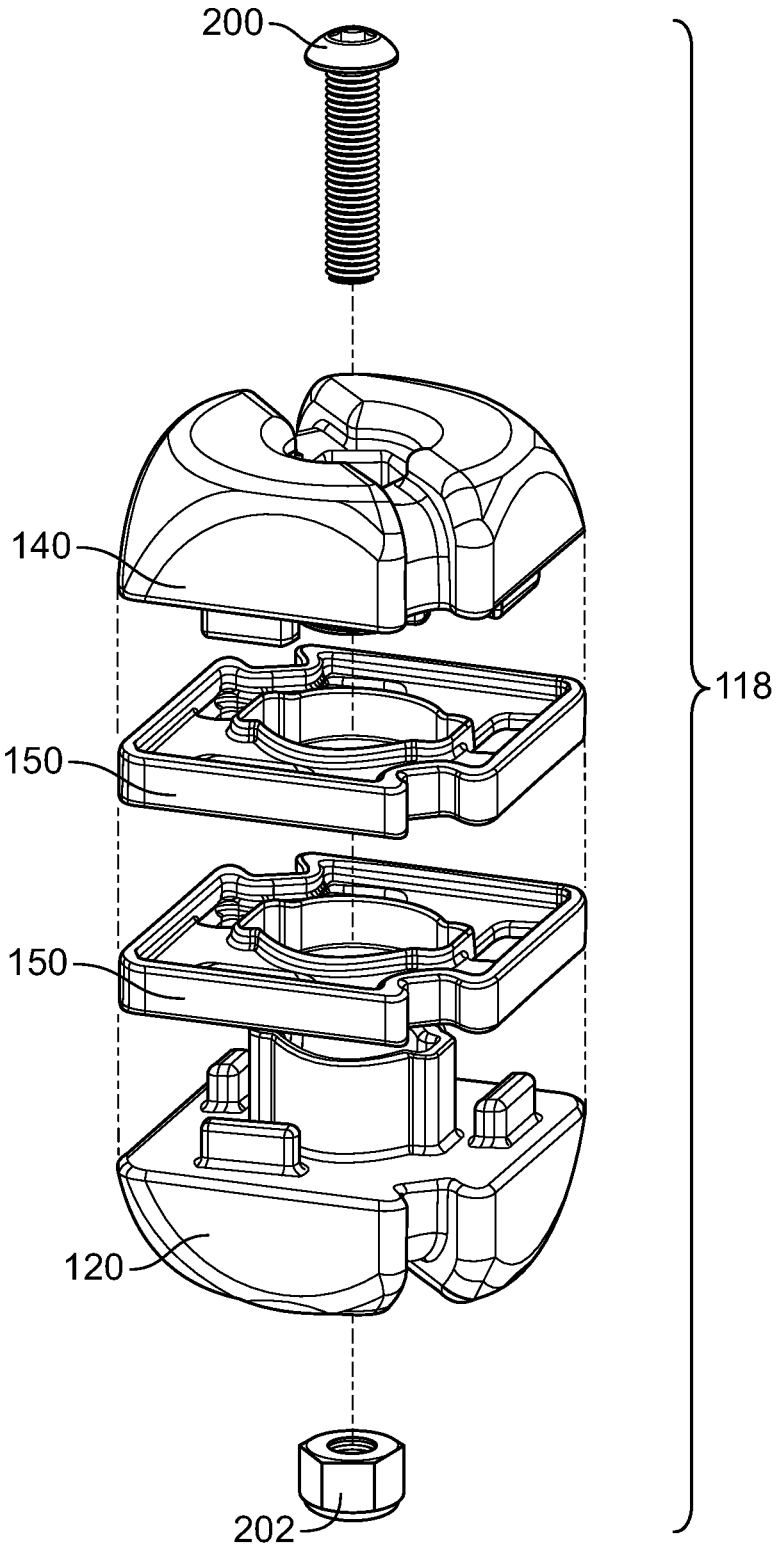
FIG. 3 is an exploded isometric view of an adjustable counterweight in accordance with the present disclosure.

Referring to FIG. 3, an example is depicted of an adjustable counterweight assembly 118 for the yo-yo 100. The counterweight assembly 118 includes a first portion 120, a second portion 140, a plurality of optional weight plates 150, a screw or bolt 200, and a nut 202. The first portion 120 and the second portion 140 are configurable to engage with the plurality of weight plates 150. The bolt 200 is centrally positioned and is designed to extend through the first portion 120, the second portion 140, and the plurality of weight plates 150, (e.g., the entire counterweight assembly 118). The nut 202 is coaxial with and configurable to the bolt 200, such that the nut 202 rotatably attaches to the bolt 200 to compress and retain the counterweight assembly 118. The counterweight assembly 118 is designed to easy attachment to a string 110 of a yo-yo.

In some embodiments, the nut 202 may be coupled to the first portion 120 using adhesive, heat staking, or any other suitable fastening means. By coupling the nut 202 to the first portion 120, a user is more easily able to assemble the counterweight assembly 118. Further, the bolt 200 may be fastened using a hex key. The head of the bolt 200 may be designed to receive the hex key, but other tools and designs may be contemplated to achieve the desired functionality of the bolt 200. Still further, various lengths, weights, and styles of bolts or screws may be used to compress and retain the assembly of the counterweight assembly 118. In some embodiments, the bolt 200 and nut 202 are not used as means for coupling the first portion 120 with the second portion 140. In some embodiments, magnets, adhesives, hook-and-loop structures, a friction fit, one or more latches, or one or more clasps may be used as means for coupling the first portion 120 with the second portion 140.

Figure 4:
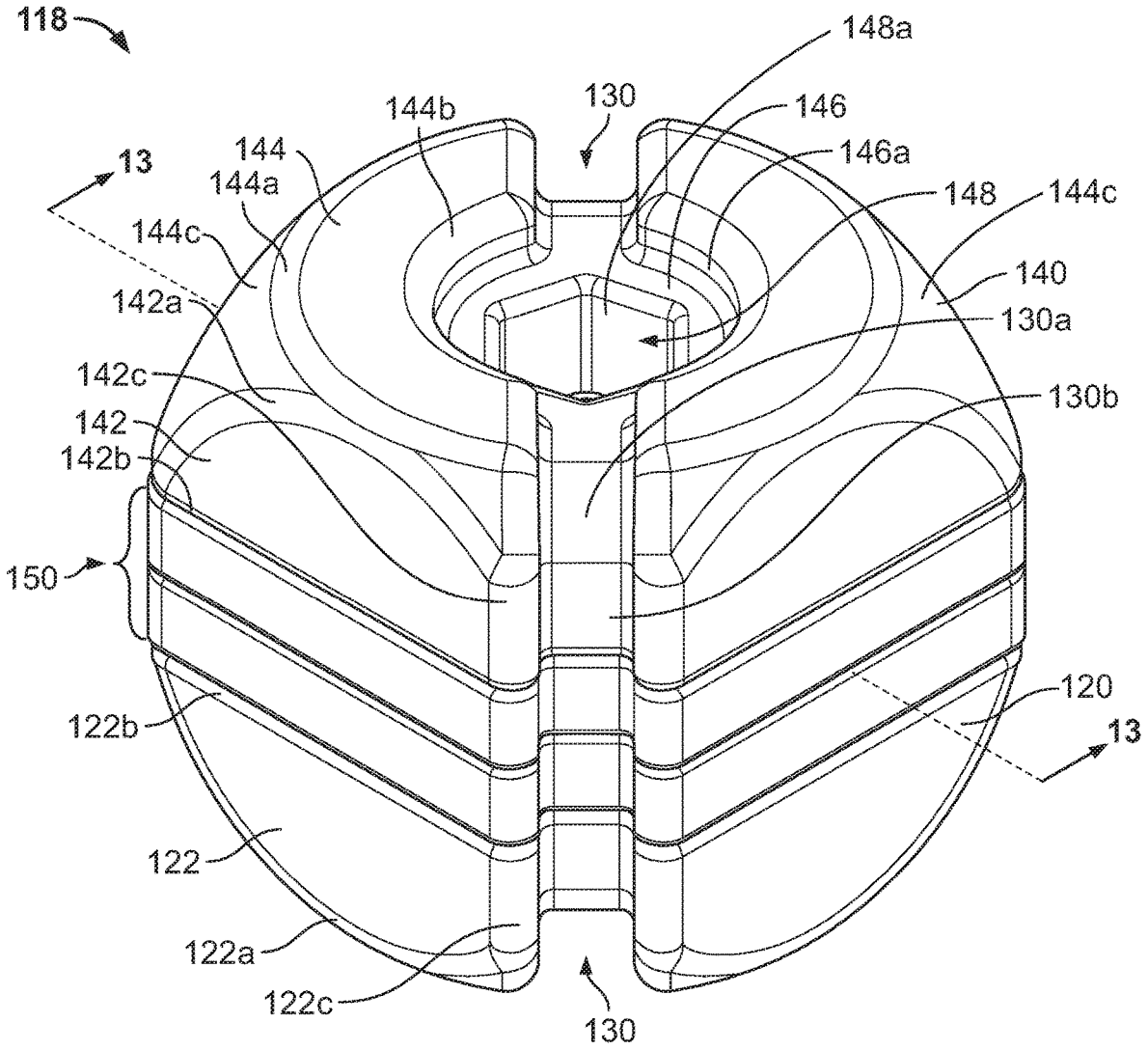
FIG. 4 is an isometric view of an adjustable counterweight.

Referring to FIG. 4, the first portion 120 includes four sides each having a quarter panel 122 defined by a curved edge 122*a*, a horizontal edge 122*b*, and a vertical edge 122*c*. The first portion 120 can have four sides, such as front, right, left, and rear sides, that each have substantially similar height and width dimensions. The quarter panel 122 of each side forms a shape similar to a half-crescent, with a broad end being substantially defined by the vertical edge 122*c* and a narrow end being defined by an intersection of the curved edge 122*a* and the horizontal edge 122*b*. The vertical edge 122*c* is adjacent a groove 130, which interrupts opposing corners and traverses three sides of the first portion 120.

Still referring to FIG. 4, the weight plates 150 are designed to be positioned between the first portion 120 and the second portion 140 within a midsection of the counterweight assembly 118, while the first portion 120 may be configurable as a bottom piece and the second portion 140 as a top piece, or vice versa. The counterweight assembly 118 is selectively configurable among a range of weight variations due to the plurality of weight plates 150 being removably disposed between the first portion 120 and the second portion 140. For example, the counterweight assembly 118 may be modified to adjust the number of weight plates 150. As depicted in FIG. 4, the counterweight assembly 118 can include two weight plates 150. However, in other embodiments, the counterweight assembly 118 may include three, four, five, six, seven, eight, nine ten, or more weight plates 150. Further, the weight plates 150 may be identical or may take on different forms.

Still referring to FIG. 4, the second portion 140 is similar in shape and overall configuration to the first portion 120, and has four sides, which may be characterized as front, right, left, and rear sides, which each have substantially similar height and width dimensions. The second portion 140 includes a quarter panel 142 on each of the four sides. The quarter panel 142 of each side forms a shape similar to a half-crescent, with a broad end being substantially defined by a vertical edge 142*c* and a narrow end being defined by an intersection of a curved edge 142*a* and a horizontal edge 142*b*. The vertical edge 142*c* is adjacent the groove 130, which interrupts opposing corners and traverses three sides of the second portion 140.

Figure 12:
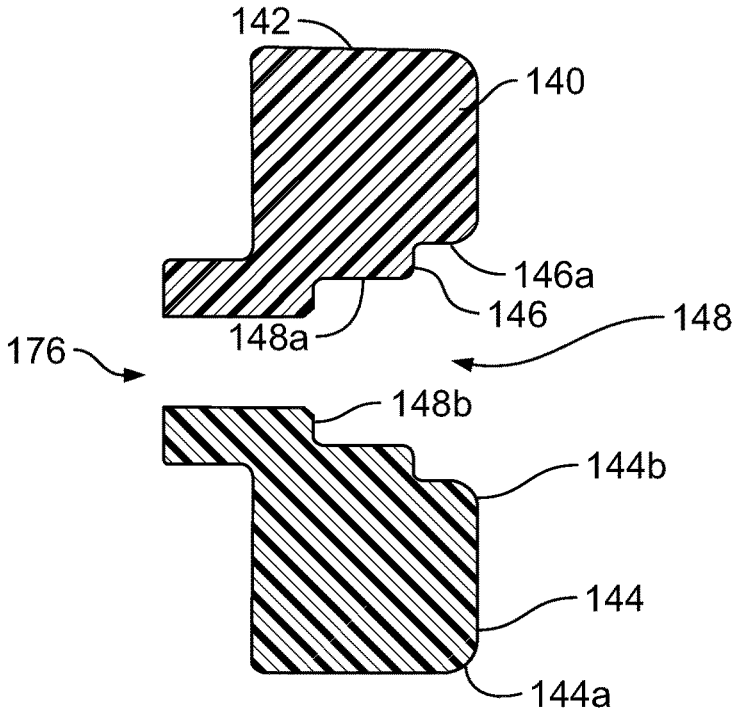
FIG. 12 is a cross-sectional view of the second portion of the adjustable counterweight taken along line 12-12 of FIG. 11.

Further, the second portion 140 includes a centrally located bore 148, as shown in FIG. 4. The bore 148 is defined by bore walls 148*a* (see FIG. 14) that extend vertically within the second portion 140. The bore walls 148*a* extend from a shelf 146 to a bore seat 148*b* (see FIG. 12), and a cylindrical perimeter that further extends from the bore seat 148*b* through a bottom or an inner surface 170, as shown in FIG. 12. The bore 148 is configured to receive the bolt 200 when assembled, as shown in FIG. 3. The shelf 146 is adjacent shelf walls 146*a* that extend around the circumference of the shelf 146. The shelf walls 146*a* are intersected at opposing points by the groove 130, at which points the shelf walls 146*a* transition from curved portions to linear portions to follow the groove 130 toward the opposing corners of the second portion 140. The shelf walls 146*a* are also adjacent an inner curved edge 144*b*, which forms the interior edge of a curved surface 144. An outer curved edge 144*a* defines an outer curvature of the curved surface 144 and intersects the curved edges 142*a* of the quarter panel 142.

Figure 9:
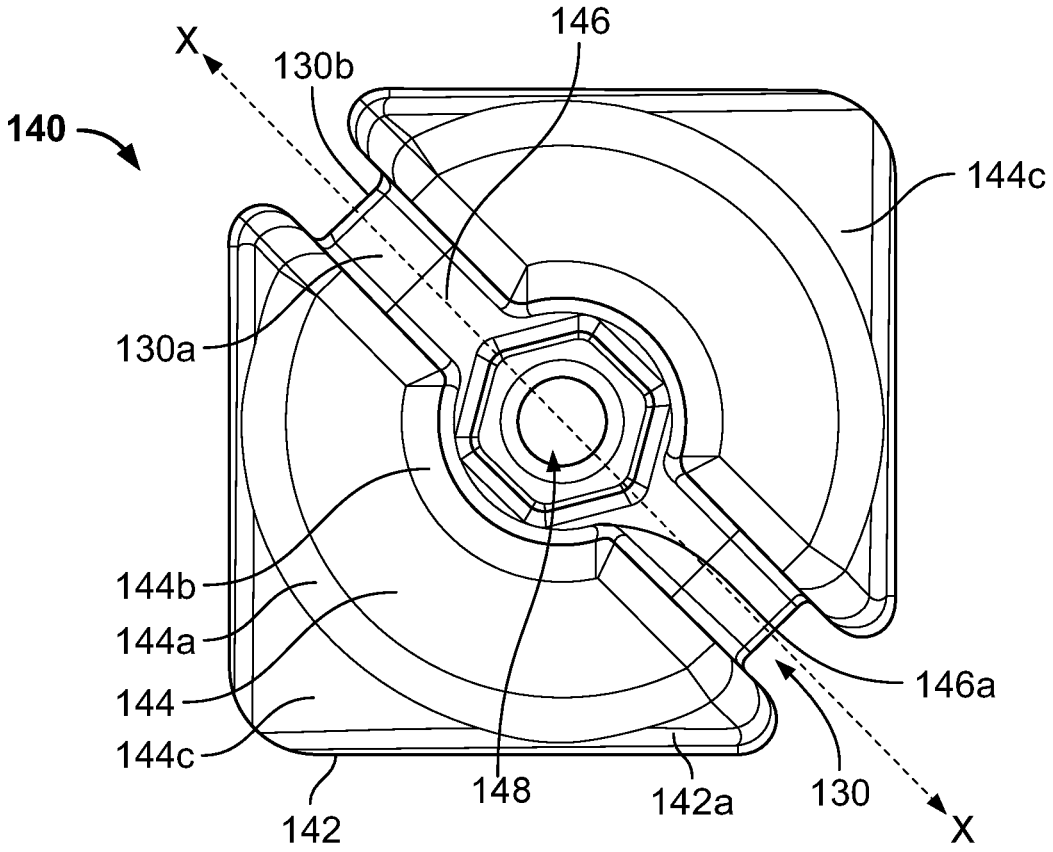
FIG. 9 is a top plan view of a second portion of the adjustable counterweight of FIG. 4.

As shown in FIGS. 4 and 9, the second portion 140 includes corner panels 144*c* defined by a perimeter comprising two of the curved edges 142*a* and an outer curved edge 144*a*. The corner panels 144*c* are chamfered to fit comfortably within a user's hand or palm. The groove 130 interrupts the curved surface 144, the inner curved edge 144*b*, the outer curved edge 144*a*, the shelf 146, and the quarter panel 142. The groove 130 extends along three sides of the second portion 140, and includes a groove arch 130*a* and a groove wall 130*b*. The groove arch 130*a* or chamfer extends around opposing corners of the second portion 140 to adjoin the shelf 146 and the groove walls 130*b*.

Figure 5:
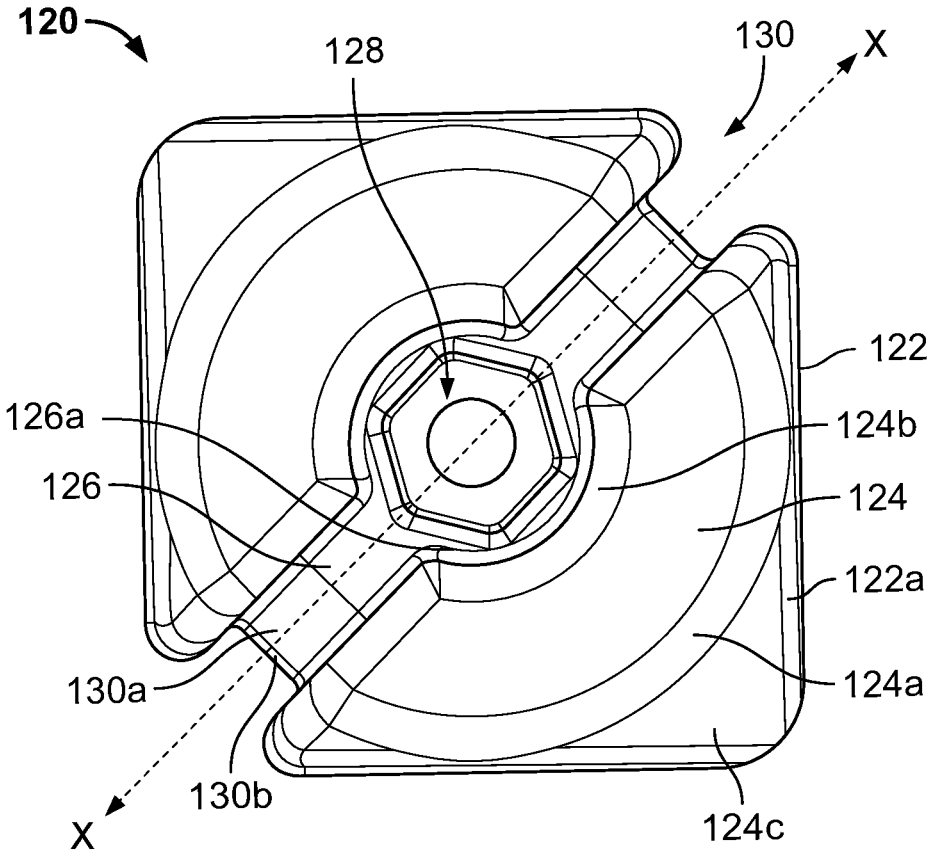
FIG. 5 is a bottom plan view of a first portion of the adjustable counterweight of FIG. 4.

Now referring to FIG. 5, a bottom of the first portion 120 includes a curved surface 124 defined by an outer curved edge 124*a* and an inner curved edge 124*b*. The curved surface 124 is interrupted by the groove 130 that extends parallel with an axis X. The inner curved edge 124*b* adjoins the shelf walls 126*a* and includes two linear portions extending from either end of the curved portion in a direction parallel with the axis X. The first portion 120 includes a bore 128 that is configured to receive the nut 202, and is coaxially aligned with both the bolt 200 and the bore 148 of the second portion 140, as shown in FIGS. 3 and 4.

Still referring to FIG. 5, the first portion 120 includes a corner panel 124*c* defined by a perimeter comprising two of the curved edges 122*a* and the outer curved edge 124*a*. The groove 130 traverses the curved surface 124, the inner curved edge 124*b*, the outer curved edge 124*a*, the shelf 126, and the quarter panel 122 such that an equal but mirrored arrangement exists on either side. The groove 130 extends along three sides of first portion 120, and includes the groove arch 130*a* and the groove wall 130*b*. The groove arch

130*a* or chamfer extends around opposing corners of the first portion 120 to adjoin the shelf 126 and the groove walls 130*b*.

Figure 6:
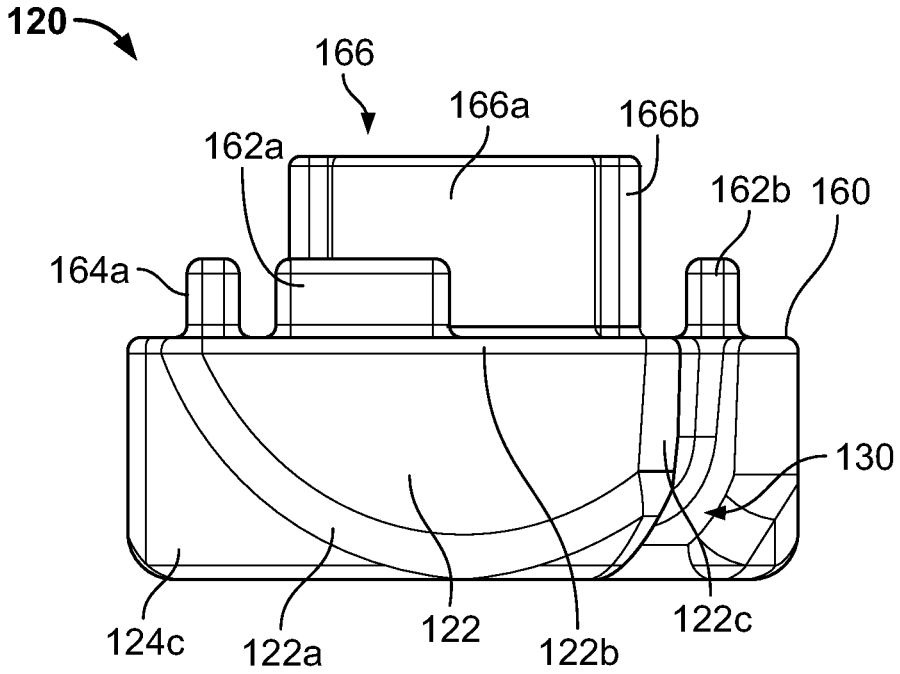
FIG. 6 is a side elevational view of a first portion of the adjustable counterweight of FIG. 4.

Referring to FIG. 6, the quarter panel 122 forms a side of the first portion 120. The groove 130 is disposed adjacent the vertical edge 122*c*, the curved edge 122*a*, and the horizontal edge 122*b*. The corner panel 124*c* is chamfered to fit comfortably within a user's hand or palm. A channel 166 is positioned centrally along the first portion 120 and extends away from a top or an inner surface 160. The channel 166 is defined by sidewalls 166*a* that extend upward from the top surface 160. The channel 166 is further defined by end walls 166*b* that are disposed along either side of the sidewalls 166*a*. The sidewalls 166*a* and end walls 166*b* are integral with one another and define a lock-and-key feature that the weight plates 150 mate with once the weight plates 150 are coupled with the first portion 120.

Figure 7:
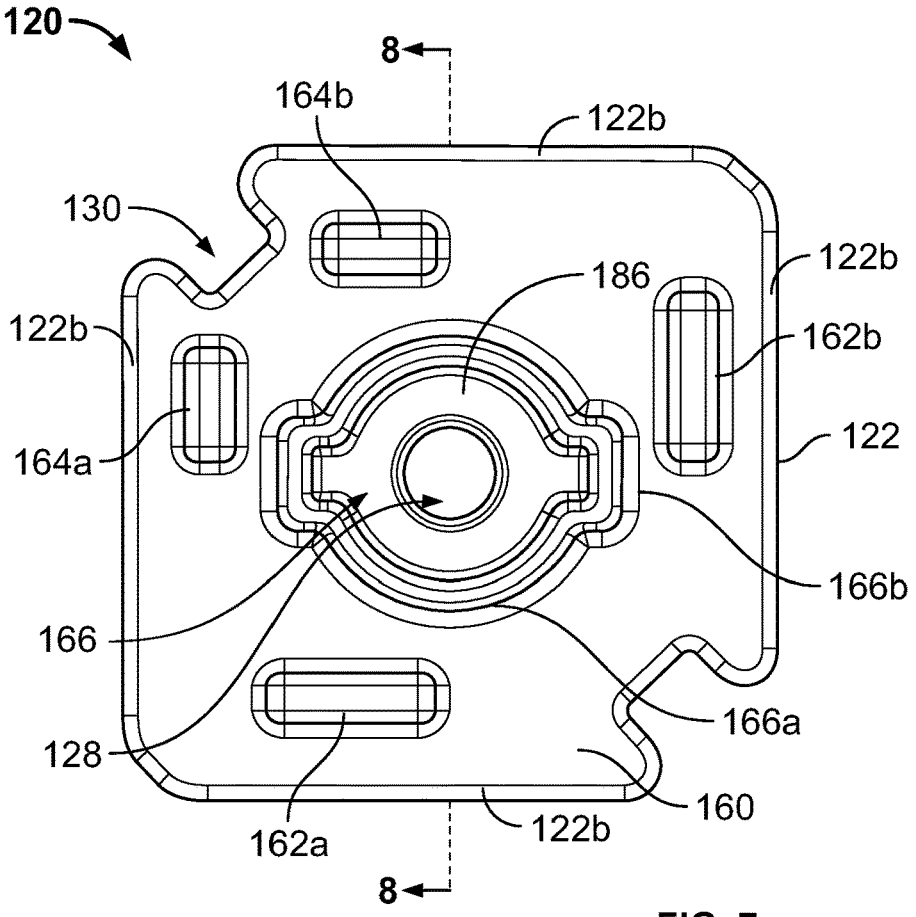
FIG. 7 is a top plan view of the first portion of the adjustable counterweight of FIG. 6.

Referring to FIGS. 6 and 7, a plurality of posts 162, 164 protrude from the top surface 160. A first or large post 162*a* protrudes from the top surface 160, a face of the first post 162*a* is parallel with the front side horizontal edge 122*b*. A second or small post 164*a* is also depicted extending from the top surface 160 of the first portion 120, the second post 164*a* having a face that is parallel with the left side horizontal edge 122*b*. A third or large post 162*b* extends from the top surface 160 such that a face thereof is parallel with the right side horizontal edge 122*b*. Further, the plurality of posts 162, 164 includes a fourth or small post 164*b* that has a face that is parallel with the rear side horizontal edge 122*b*. The posts 162, 164 include the posts 162*a*, 162*b*, 164*a*, 164*b*, which are arranged in such a way as to provide a lock-and-key function with the weight plates 150. The configuration of the posts 162, 164 is arranged to receive the plurality of weight plates 150 and the second portion 140, which allows for a plurality of selectable assemblies. Within the channel 166, a chamber seat 186 is located within the first portion 120 and at a first end of the bore 128. Alternative configurations of the posts 162, 164 are contemplated.

Figure 8:
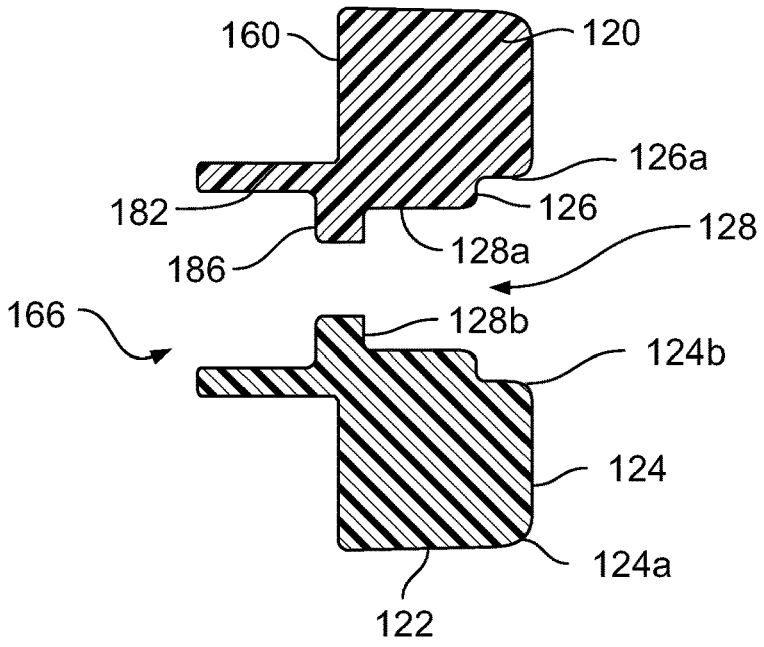
FIG. 8 is a cross-sectional view of the first portion of the adjustable counterweight taken along line 8-8 of FIG. 7.

FIG. 8 illustrates the bore 128 of the first portion 120, which is centrally located and has a perimeter of bore walls 128*a* that extend vertically within the first portion 120 from the shelf 126 to a bore seat 128*b*. The bore walls 128*a* define a perimeter that further extends from the bore seat 128*b* through the top surface 160. The bore 128 is configured to receive the nut 202 when assembled, as shown in FIG. 3. A plurality of chamber walls 182 extend from the chamber seat 186 within the chamber 180. The shelf 126 is adjacent shelf walls 126*a* that extend along the circumference of the shelf 126. The shelf walls 126*a* are intersected at opposing ends by the groove 130. The shelf walls 126*a* are also adjacent an inner curved edge 124*b*, which forms the interior edge of the curved surface 124. The outer curved edge 124*a* defines an outer curvature of the curved surface 124 and intersects the curved edges 122*a* of the quarter panel 122.

Referring to FIG. 9, the second portion 140 includes the curved surface 144, which is defined by an outer curved edge 144*a* and an inner curved edge 144*b*. The curved surface 144 is interrupted by the groove 130, which is disposed parallel with respect to the axis X. The inner curved edge 144*b* includes a curved section that is directly adjacent the shelf walls 146*a* and two linear portions that extend parallel with respect to the axis X. The bore 148 is configured to receive the bolt 200, and has a coaxial alignment with the bore 128 of the first portion 120 when assembled, as shown in FIGS. 3 and 4.

Figure 10:
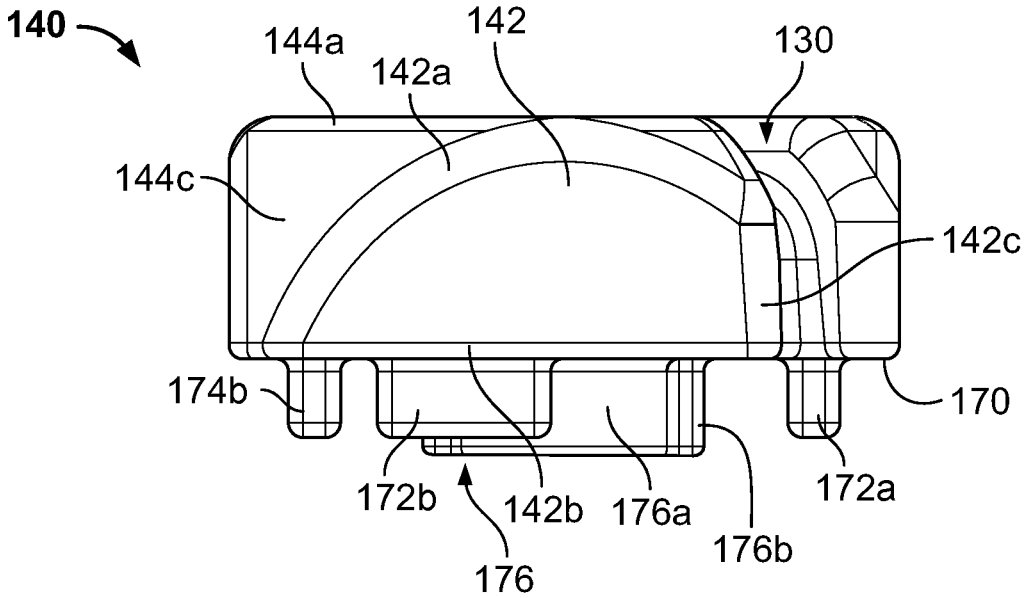
FIG. 10 is a side elevational view of the second portion of the adjustable counterweight of FIG. 9.

Referring to FIG. 10, the quarter panel 142 forms a side of the second portion 140. The groove 130 extends adjacent the vertical edge 142*c*, the curved edge 142*a*, and the horizontal edge 142*b*. A key 176 is positioned centrally on the second portion 140 and extends from the bottom surface 170. The key 176 is defined by sidewalls 176*a* and end walls 176*b*. The key 176 is configured to fit into the channel 166 by aligning the end walls 176*b* and 166*b*, respectively, whereby the first portion 120 and second portion 140 are then assembled as shown in FIG. 3 or 4. Further, the key 176 and the channel 166 are configured to receive the bolt 200 in order to retain the assembly in an assembled configuration.

Figure 11:
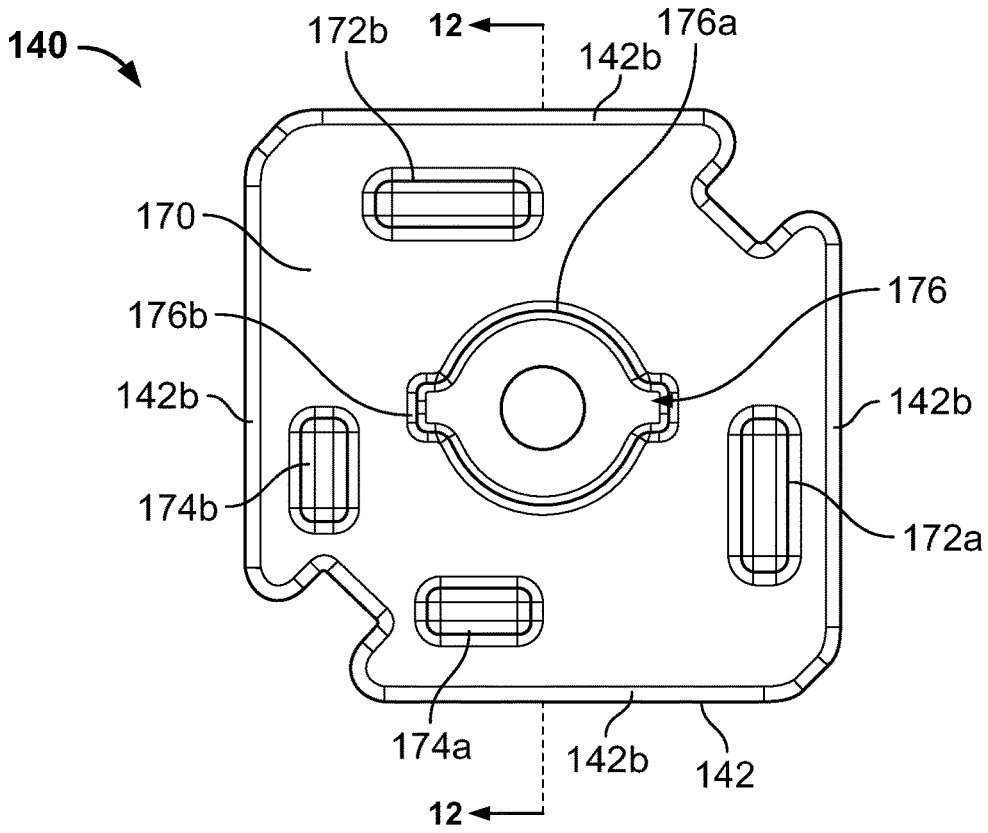
FIG. 11 is a bottom plan view of the second portion of the adjustable counterweight of FIG. 9.

Now referring to FIG. 11, a plurality of posts 172, 174 protrude from the bottom surface 170. A first or large post 172*a* is depicted extending from the bottom surface 170 of the second portion 140, wherein a face of the first post 172*a* is parallel with the nearest quarter panel 142. A second or small post 174*a* is also depicted as extending from the bottom surface 170 of the second portion 140, having a face that is perpendicular to the face of the first post 172*a*. A third or large post 172*b* extends from the bottom surface 170 such that a face thereof is parallel with the face of the second post 174*a* and perpendicular to the face of the first post 172*a*. Further, the plurality of posts 172, 174 includes a fourth or small post 174*b* that has a face that is parallel with a face of the first post 172*a*. The plurality of posts 172, 174 includes the posts 172*a*, 172*b*, 174*a*, 174*b*. The plurality of posts 172, 174 is configured to receive the plurality of weight plates 150 and the first portion 120. FIG. 12 illustrates the bore 148, which is centrally located within the second portion 140 and defined by a plurality of bore walls 148*a* that extend from the shelf 146 to the bore seat 148*b* and through the key 176. The bore 148 is configured to receive the bolt 200 when assembled. The shelf walls 146*a* extend about the circumference of the shelf 146.

Figure 13:
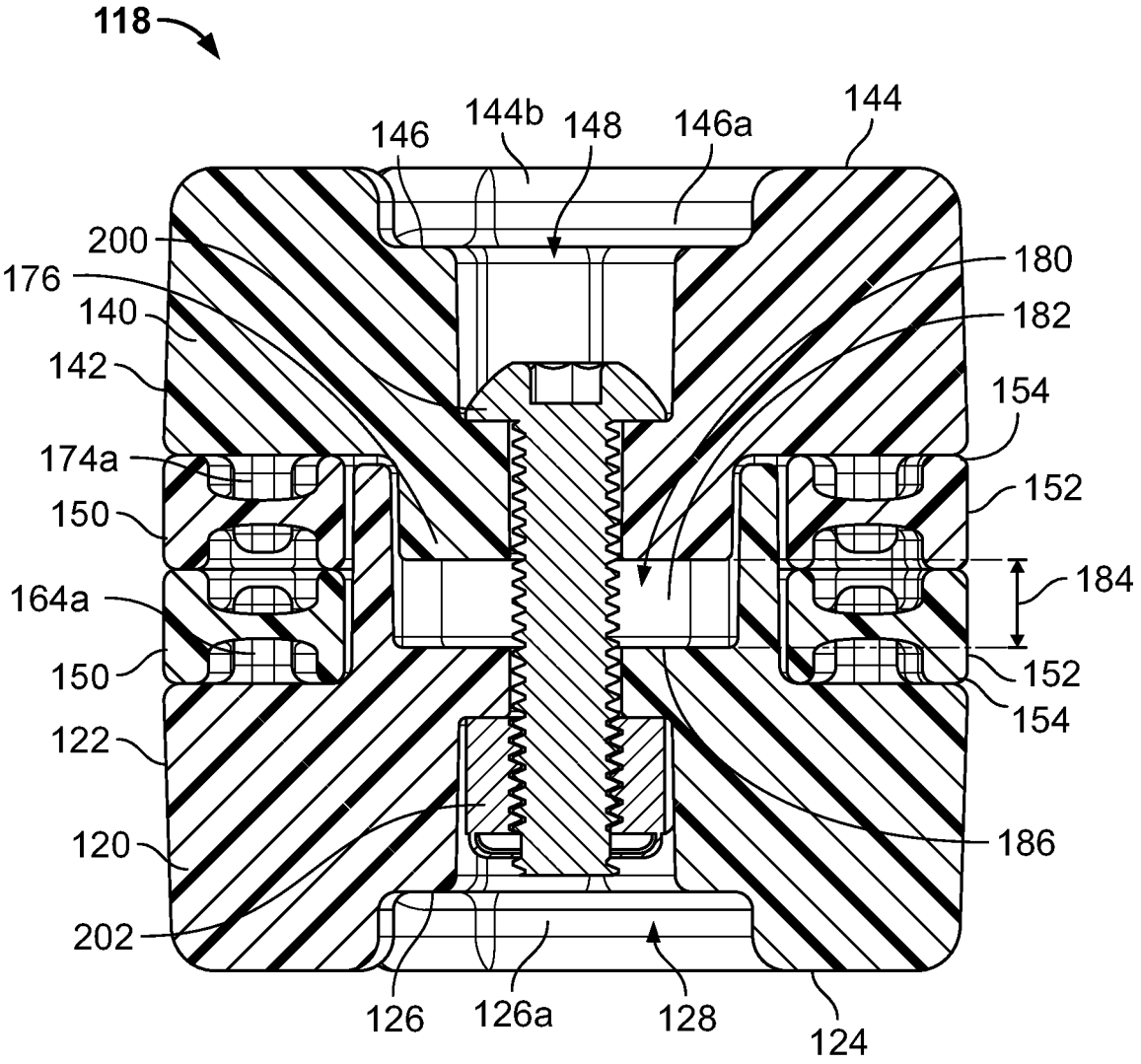
FIG. 13 is a cross-sectional view of the adjustable counterweight taken along line 13-13 of FIG. 4.

Referring to FIG. 13, a cross-sectional view of the assembled counterweight assembly 118 is depicted with two of the weight plates 150 positioned between the first portion 120 and the second portion 140. The second portion 140 receives the bolt 200 within the bore 148 while the first portion 120 receives the nut 202 within the bore 128 in coaxial alignment to allow a user to rotatably fasten the bolt 200 to the nut 202. The weight plates 150 are also depicted within a midsection of the counterweight assembly 118, whereby the sidewalls 152 and a pair of peripheral edges 154 are exposed to the environment. The adjacent surfaces can be one of the peripheral edges 154 on the additional weight plates 150, or the top surface 160 of the first portion 120, or the bottom surface 170 of the second portion 140.

Still referring to FIG. 13, a chamber 180 is disposed within the channel 166. The chamber 180 extends between the first portion 120 and the second portion 140 when the counterweight assembly 118 is assembled. Accordingly, the chamber 180 has a depth 184 that varies depending on the desired configuration of the counterweight assembly 118. A user may selectively arrange the weight plates 150 and the first and second portions 120, 140 such that the depth 184 may be increased or decreased, further depending on the bolt 200 and nut 202 utilized to couple the assembly. The key 176 forms a ceiling of the chamber 180 as it fits into the channel 166, while the chamber seat 186 serves as a floor. The chamber walls 182 are formed inside of the chamber 180 adjacent the chamber seat 186 within the first portion 120. The chamber walls 182 follow a profile of the sidewalls 166*a* and the end walls 166*b*, as illustrated in FIGS. 8 and 13.

By fitting the end walls 176*b* of the key 176 into a cavity defined by the end walls 166*b* of the channel 166, the first portion 120 and the second portion 140 can be engaged in a manner that promotes alignment of the groove 130 and further promotes alignment of the bores 128, 148. The alignment of the key 176 and the channel 166 further prevents rotation of the first portion 120 relative to the second portion 140. In some examples, the sidewalls 176*a* of the key 176, or the end walls 176*b*, or some combination thereof, may be tapered to promote more or less interaction with the chamber walls 182 of the channel 166. In other examples, the key 176 may extend varying distances into the channel 166, such that the depth 184 of the chamber 180 can be greater or smaller.

Figure 14:
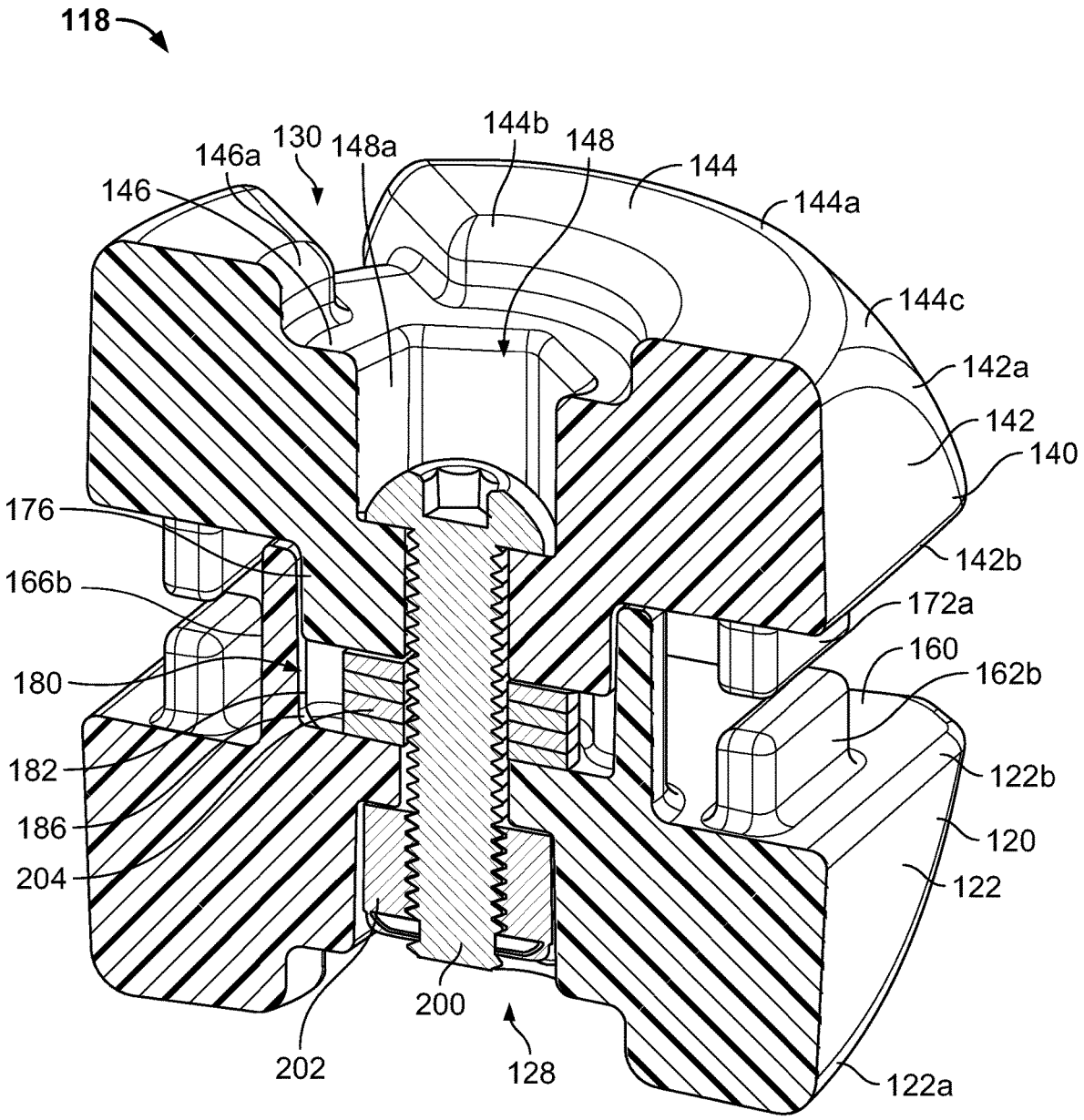
FIG. 14 is a cross-sectional view of the adjustable counterweight taken along line 13-13 of FIG. 4 in an alternative configuration, which includes multiple washers being added and the absence of weight plates.

It is contemplated that the chamber 180 may be left empty, as desired by a user. However, it is contemplated that the chamber 180 may contain additional weights, fluids, or materials. For example, the chamber 180 may contain a plurality of washers 204 (see FIG. 14) having varying individual weights. A user may add or subtract the washers 204 prior to assembling the counterweight assembly 118 in order to achieve a desired weight for performing various maneuvers, as depicted in FIG. 14. The user may further modify the assembly to remove the weight plates 150, as shown in FIG. 14, or to include the weight plates 150 in addition to the washers 204 for further weight selection of the counterweight assembly 118. While the addition or subtraction of weight plates 150 is contemplated to have an effect on the weight of the counterweight assembly 118, the addition or subtraction of washers 204 permits finer adjustment of the weight of the assembly 118. In this way, a user may select a more precise weight for the counterweight assembly 118 before performing a particular maneuver.

Figure 15:
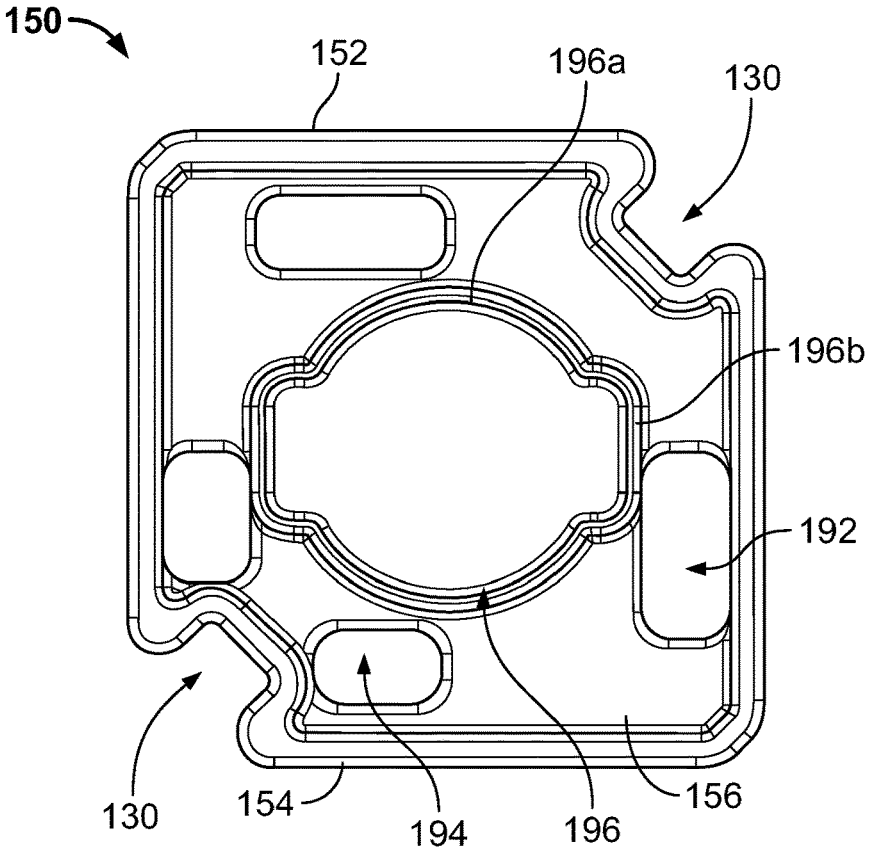
FIG. 15 is a top plan view of a weight plate for the adjustable counterweight device of FIG. 4.

A plurality of weight plates 150 may be coupled to and between the first and second portions 120, 140 of the adjustable counterweight 118, as shown in FIG. 3-4. Each of the weight plates 150 include four sidewalls 152 having substantially similar length and height dimensions, as depicted in FIG. 15. The sidewalls 152 are defined between the pair of peripheral edges 154 extending along a perimeter of the weight plate 150. The groove 130 is disposed on opposing corners of the sidewalls 152 and the peripheral edges 154. The groove 130 interrupts the sidewalls 152 to form a groove wall 130*b*, which aligns with the groove walls 130*b* located on the first and second portions 120, 140, when assembled. The recessed surfaces 156 have a perimeter that is defined by the pair of peripheral edges 154, sidewalls 152, and the groove 130. The recessed surfaces 156 are defined by opposing top and bottom surfaces of each of the weight plates 150.

Each of the weight plates 150 includes a key hole 196 that is centrally positioned within and extending through the recessed surfaces 156, which permits alignment with the channel 166 and key 176 of the first and the second portions 120, 140, respectively, when assembled. The key hole 196 comprises a rounded portion 196*a* and guide portions 196*b*. Further, each of the weight plates 150 includes a plurality of first or large apertures 192 and second or small apertures 194 that are configured to align with the plurality of posts 162, 164, 172, 174 that protrude from the first portion 120 and the second portion 140, respectively, when the counterweight assembly 118 is assembled. Each of the weight plates 150 may be configured to receive the plurality of posts 162, 164, 172, 174 through the large apertures 192 and small apertures 194.

Figure 18:
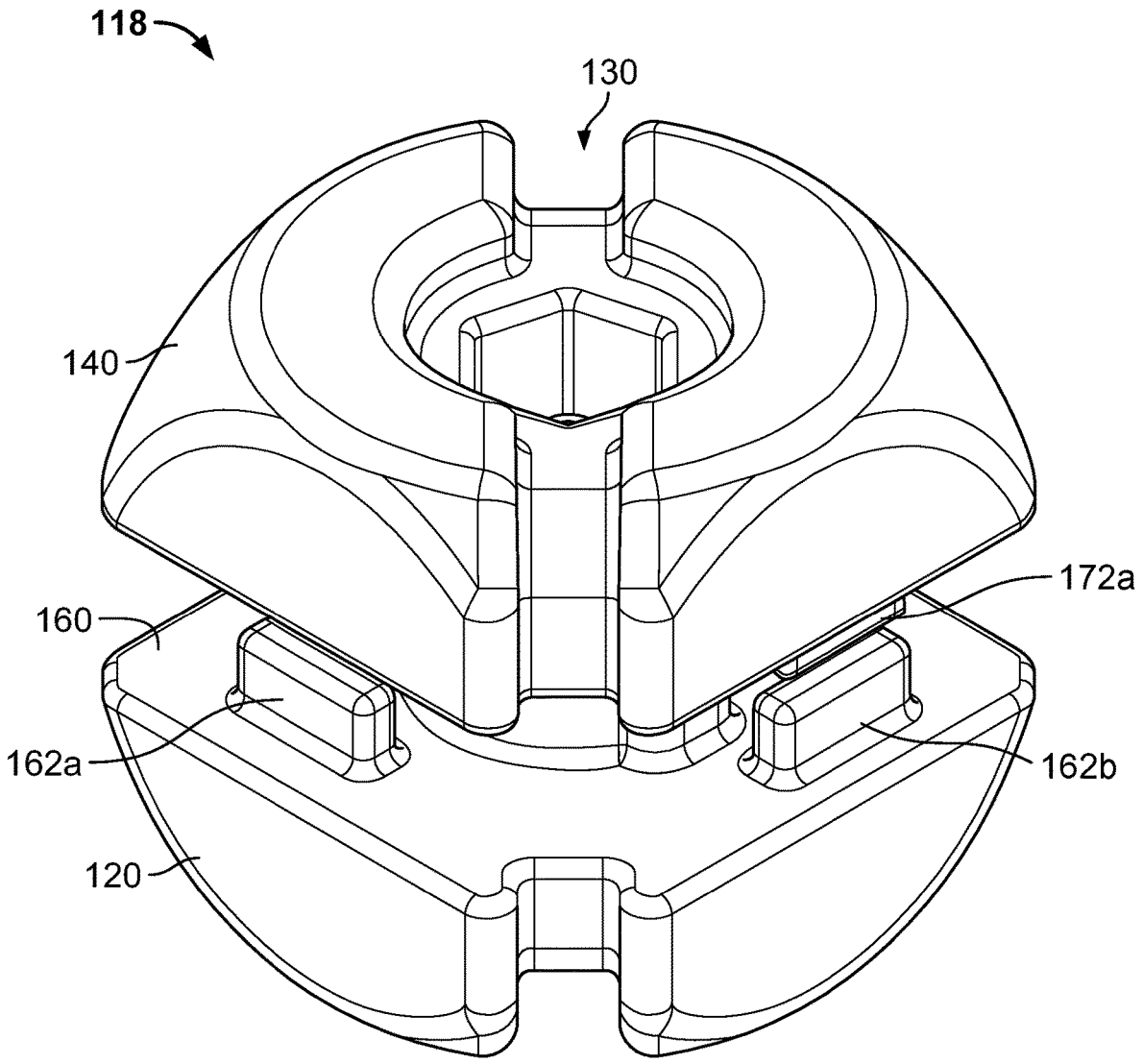
FIG. 18 is an isometric view of the first and second portions of the adjustable counterweight of FIG. 4.
Figure 22:
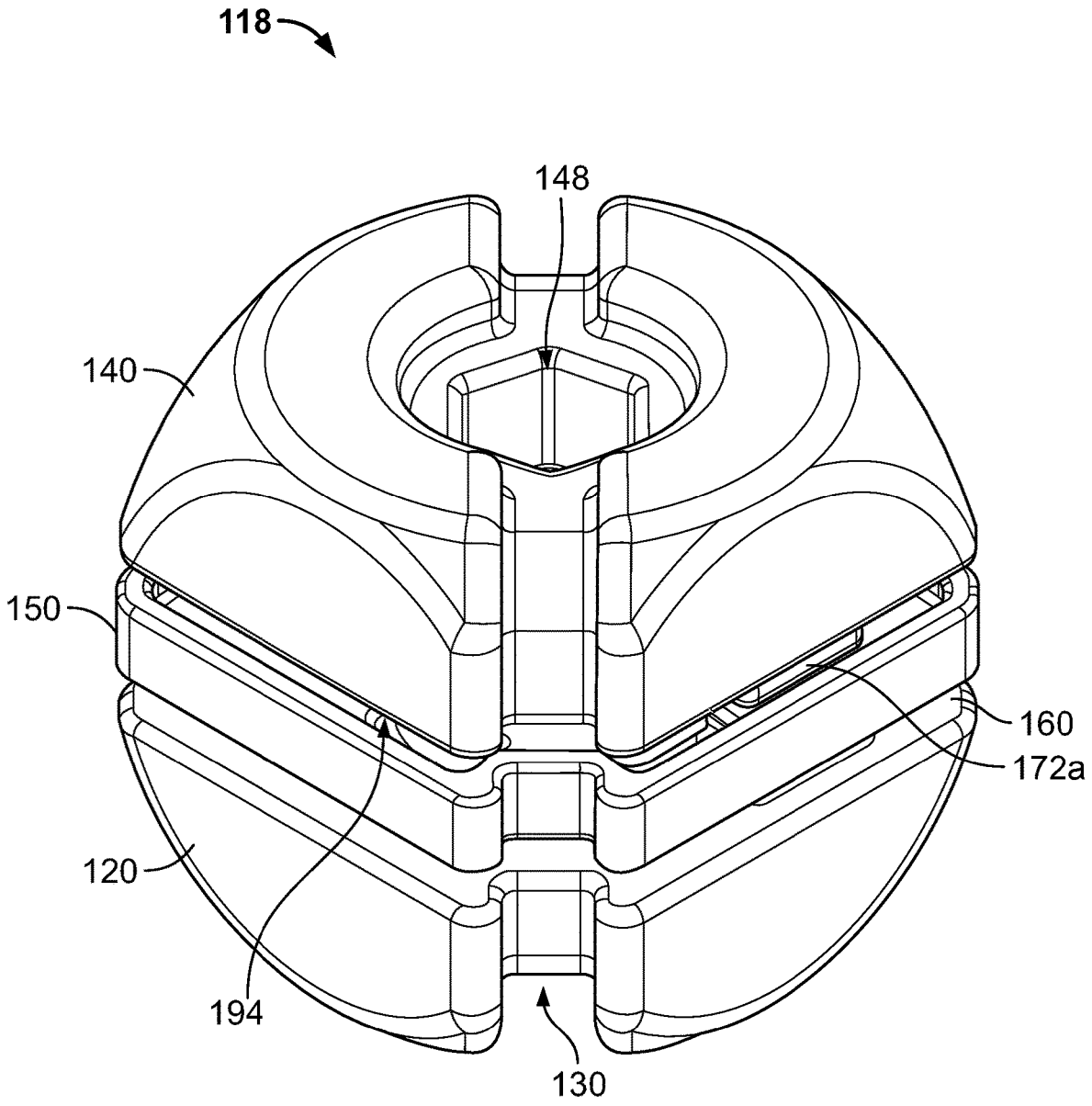
FIG. 22 is an isometric view of the adjustable counterweight assembled with a single weight plate.
Figure 23:
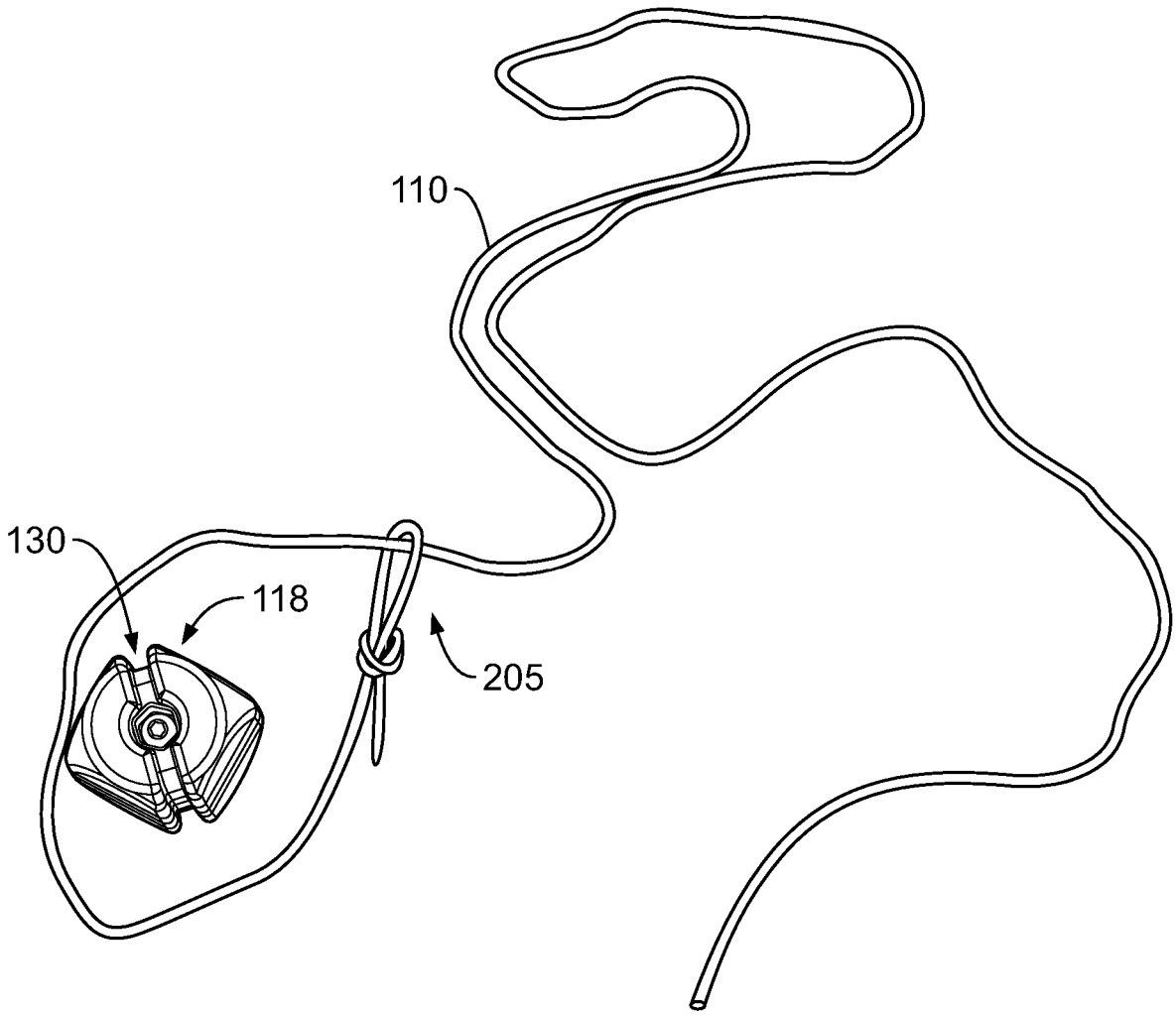
FIG. 23 is an isometric view of a string that is detached from the adjustable counterweight.
Figure 24:
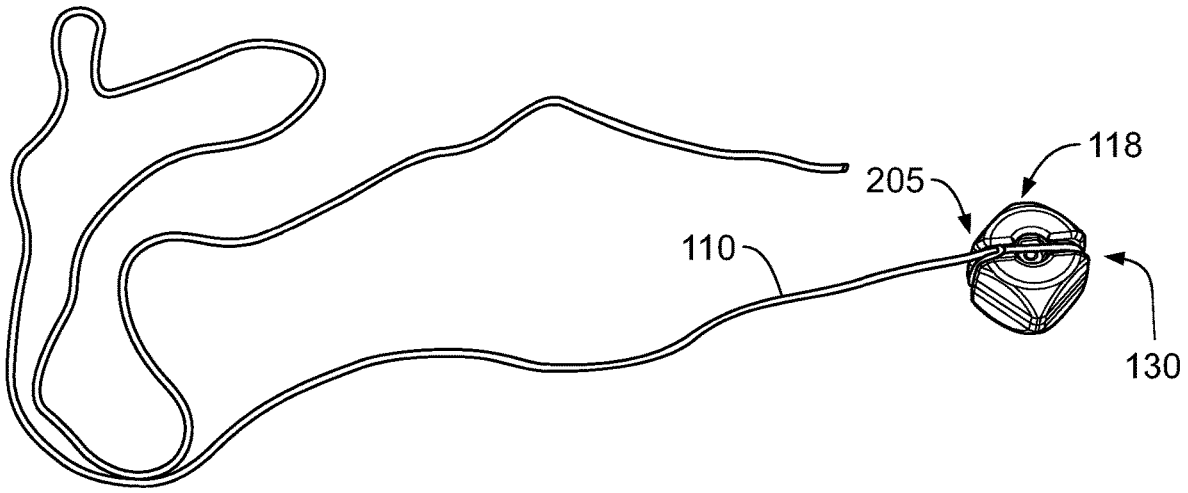
FIG. 24 is an isometric view of a string attached to the adjustable counterweight.
Figure 25:
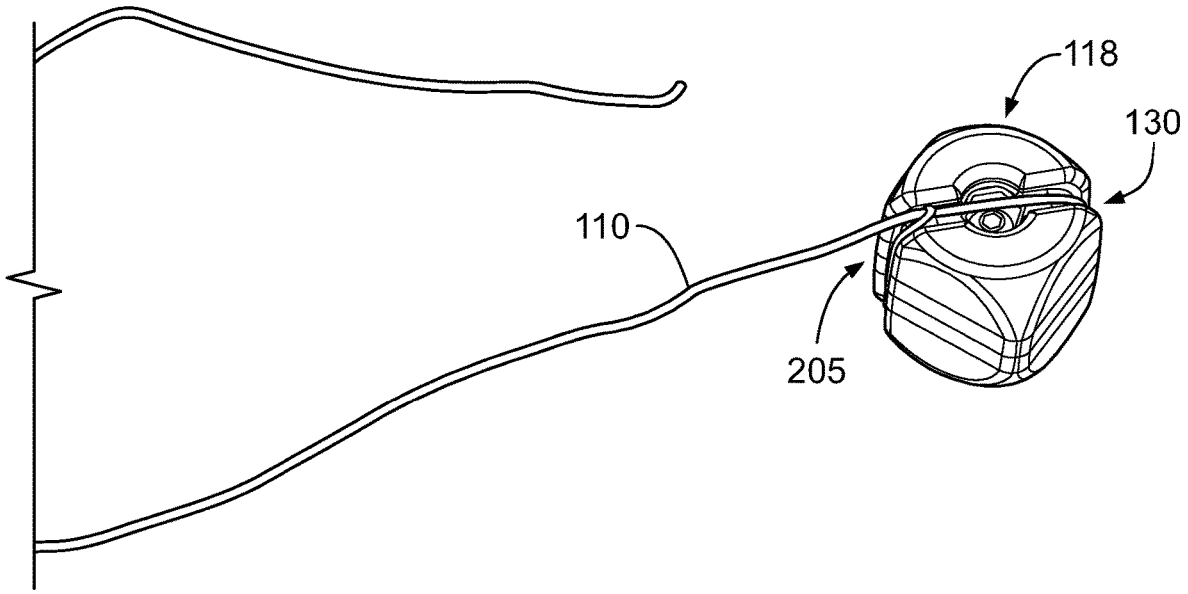
FIG. 25 is an enlarged isometric view of the string of FIG. 24 shown attached to the adjustable counterweight.

Alternatively, the weight plates 150 may be oriented such that the plurality of posts 162, 164, 172, 174 contact the opposing recessed surfaces 156. A user may desire to install a plurality of weight plates 150 within the counterweight assembly 118, in which case the former configuration may be suitable as shown in FIG. 4. Alternatively, the user may desire to install a single weight plate 150 in the counterweight assembly 118, in which case the latter configuration may be suitable as shown in FIG. 22. Further, the user may desire not to install a weight plate 150 between the first portion 120 and the second portion 140 of the counterweight assembly 118, as shown in FIG. 18.

Figure 16:
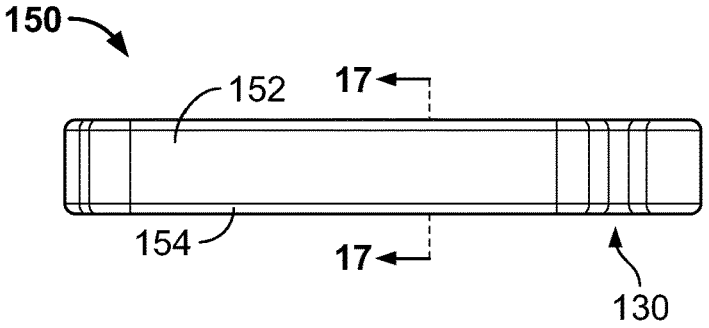
FIG. 16 is a side elevational view of the weight plate of FIG. 15.
Figure 17:
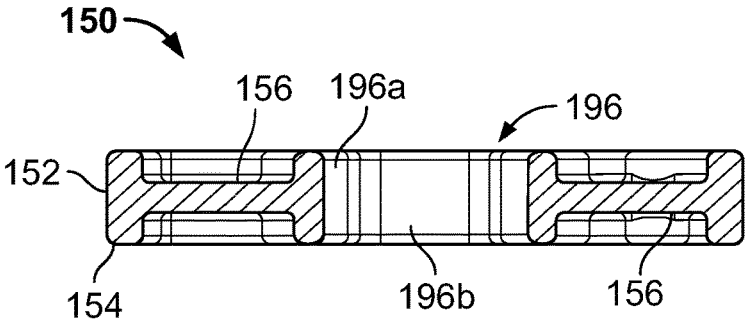
FIG. 17 is a cross-sectional view of the weight plate taken along line 17-17 of FIG. 16.

As shown in FIG. 17, the recessed surfaces 156 of each weight plate 150 are disposed at a height that is less than a height of sidewalls 152. A cross-section of the weight plate 150 of FIG. 16 illustrates a profile resembling a dumbbell or an I-beam formed by the recessed surfaces 156 and the sidewalls 152, while the key hole 196 extends through a center. The guide portion 196*b* and the rounded portion 196*a* of the key hole 196 are also illustrated as having a similar height as the sidewalls 152. The pair of peripheral edges 154, which are formed on the top and bottom perimeter of sidewalls 152, are substantially horizontal, such that the pair of peripheral edges 154 may abut another of the weight plates 150, the first portion 120, or the second portion 140, depending on the desired assembly of counterweight assembly 118.

Figure 19:
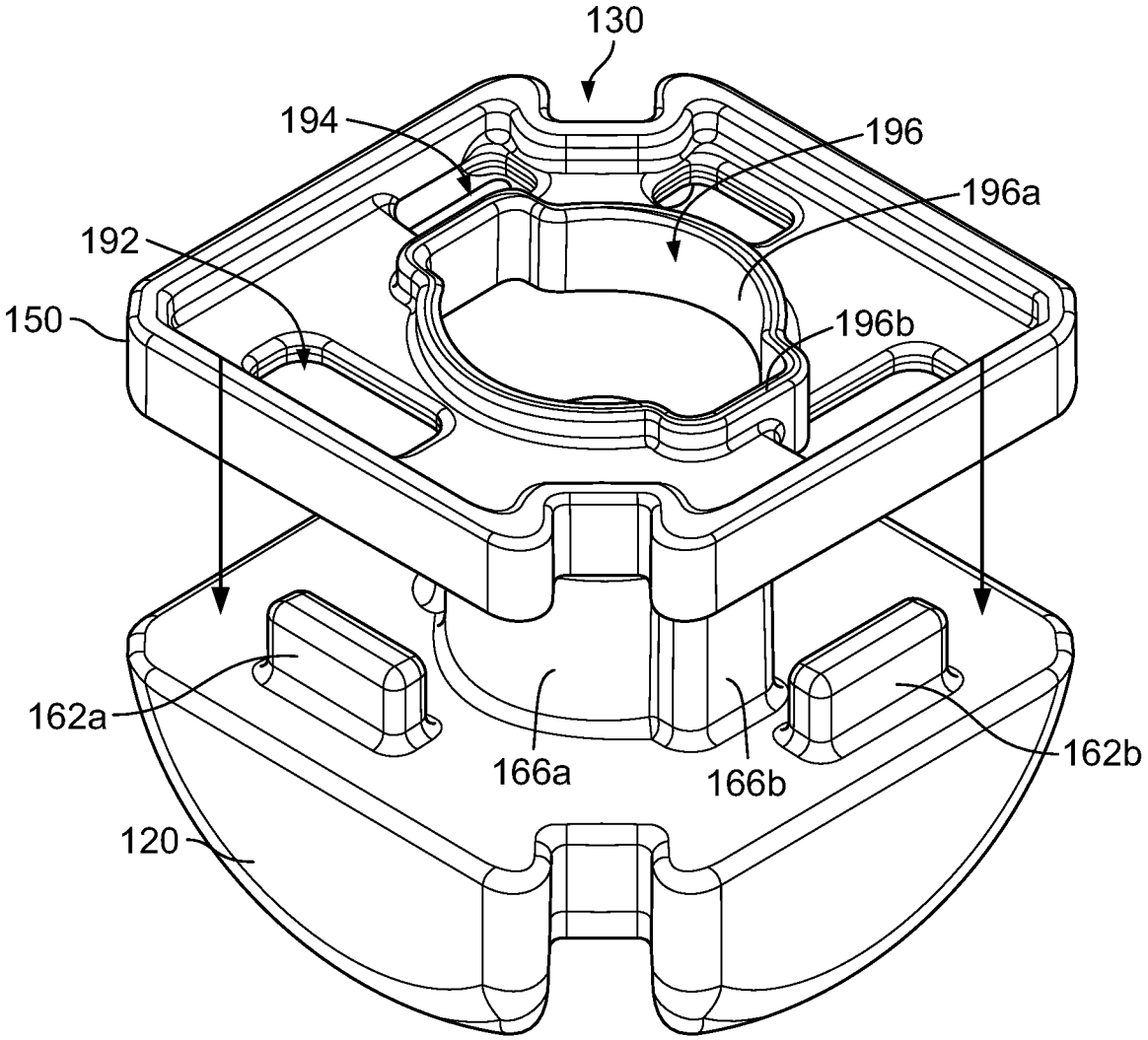
FIG. 19 is an isometric view that illustrates an assembly step depicting the weight plate of FIG. 15 being coupled to and the first portion of FIG. 5.

Referring to FIG. 19, the process of assembling the counterweight assembly 118 may begin by inserting a weight plate 150 onto the first portion 120 as shown by the directional arrows. The user aligns the groove 130 on the weight plate 150 with the groove 130 on the first portion 120. In some embodiments, the user may choose to align the large apertures 192 to fit over the large posts 162*a* and 162*b*. Accordingly, the small apertures 194 also fit over the small posts 164*a* and 164*b*. Further, the key hole 196 is aligned with the channel 166 such that the guide portions 196*b* are positioned to fit about the end walls 166*b*, while the rounded portion 196*a* is positioned to fit around the sidewalls 166*a*.

Figure 20:
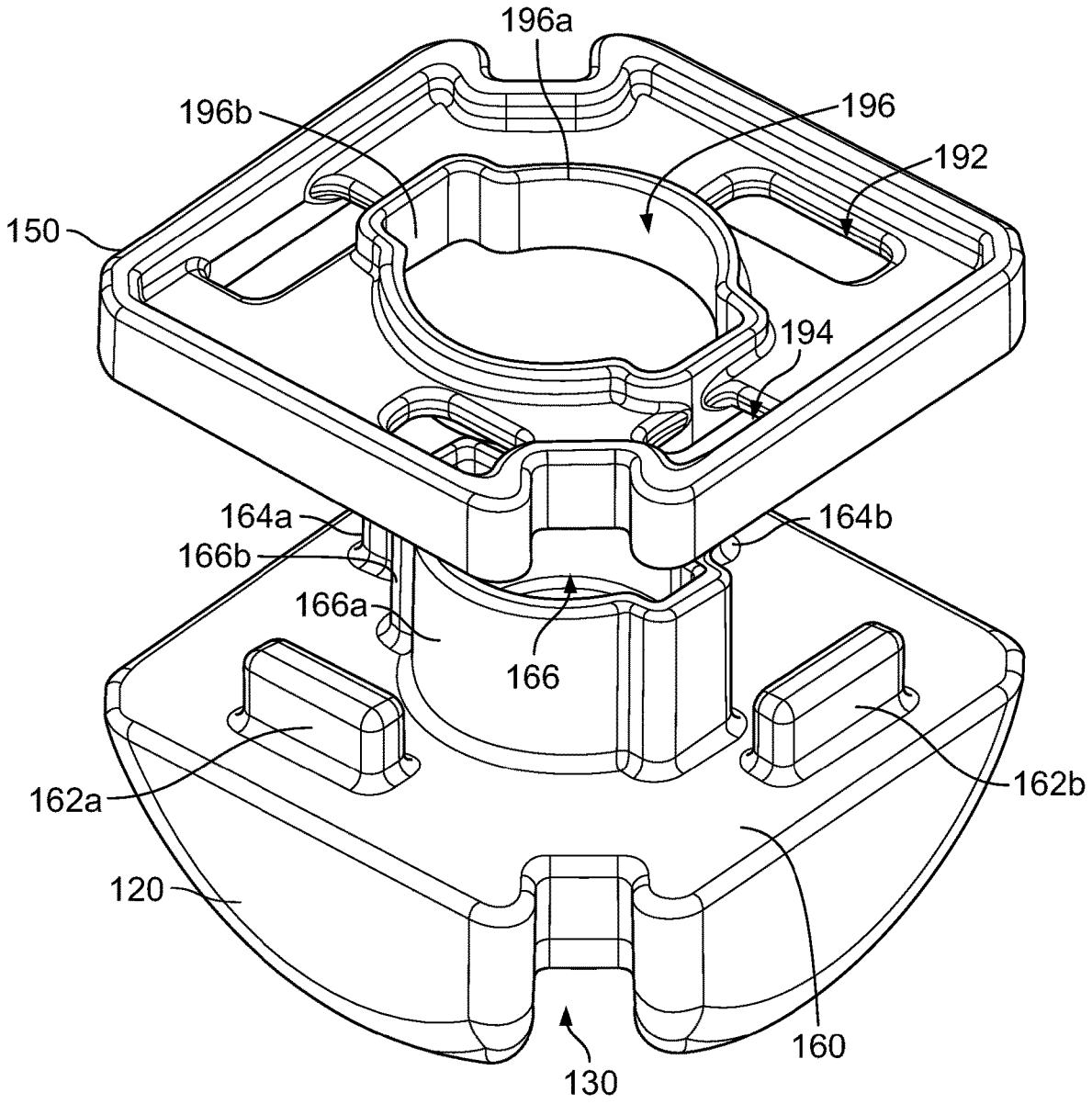
FIG. 20 is an isometric view that illustrates another assembly depicting the weight plate of FIG. 15 being rotated with respect to the first portion of FIG. 5.
Figure 21:
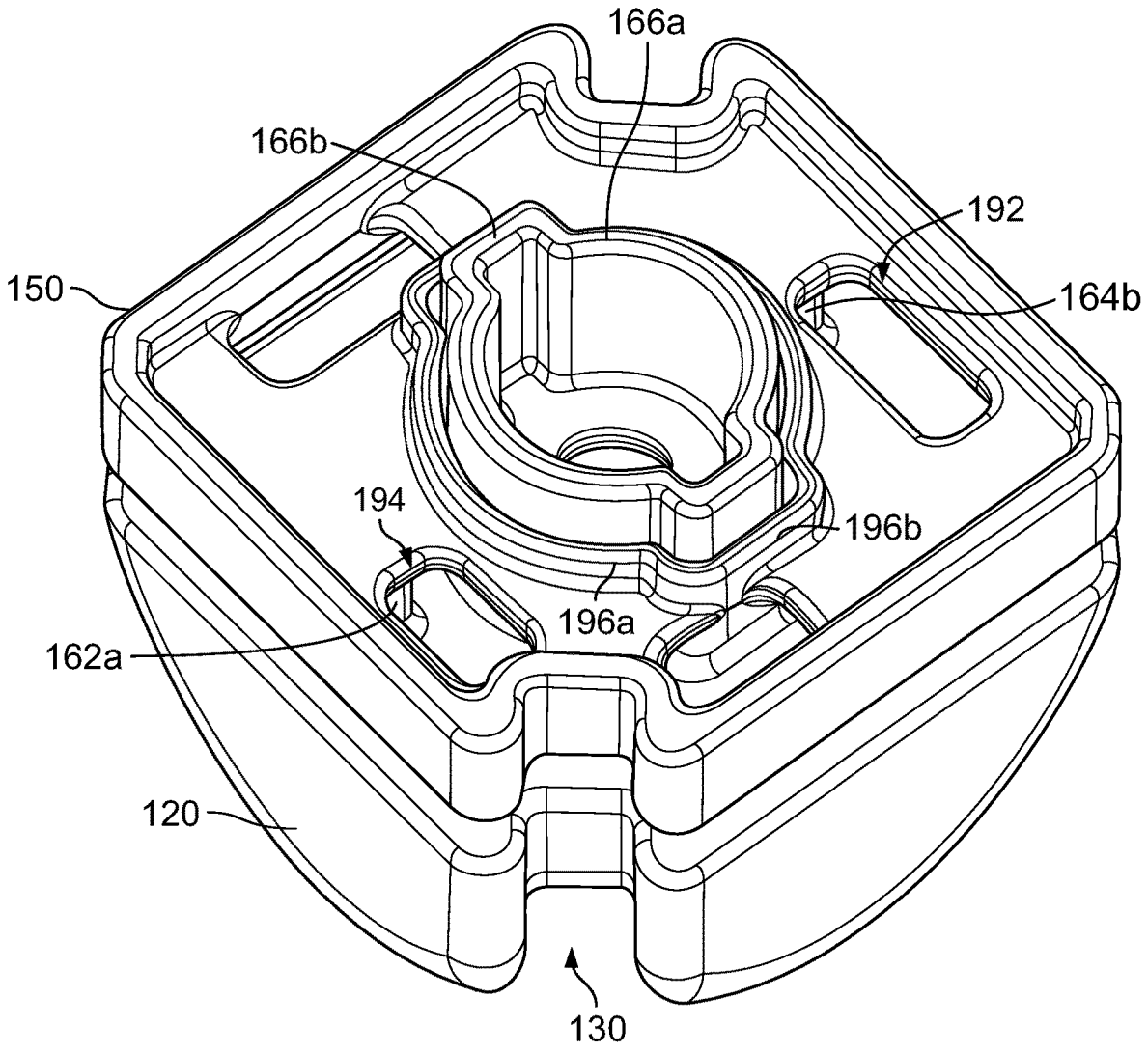
FIG. 21 is an isometric view of a single weight plate installed on the first portion of the adjustable counterweight.

Now referring to FIGS. 20 and 21, some embodiments of the counterweight assembly 118 may involve the weight plate 150 being rotated about a central, vertical axis that passes through the key hole 196 such that the small apertures 194 and large apertures 192 do not align with the small posts 164*a* and 164*b* or the large posts 162*a* and 162*b*. Then, the user may insert the weight plate 150 onto the first portion 120 so that the key hole 196 fits about the channel 166. By doing so, the guide portions 196*b* fit around the end walls 166*b*, the rounded portion 196*a* fits around the sidewalls 166*a*, and the grooves 130 of both the weight plate 150 and the first portion 120 are aligned. The plurality of posts 162, 164 now contact one of the recessed surfaces 156 of the weight plate 150, thereby allowing the weight plate 150 to sit above the top surface 160 without contacting each other directly.

In later steps of the assembly, the key 176 of the second portion 140 may be inserted through the weight plate 150, as depicted in FIG. 22. Similar to the assembly of the weight plate 150 and the first portion 120, the plurality of posts 172, 174 that protrude from the bottom surface 170 of the second portion 140 directly contact one of the recessed surfaces 156 of the weight plate 150. Accordingly, the plurality of posts 172, 174 do not align with the small apertures 194 or large apertures 192 of the weight plate 150.

Depending on the desired weight and application, a user may choose among a multitude of configurations for the counterweight assembly 118 that are suitable for performing with various sizes and weights of yo-yos. For example, a user may choose a lightweight assembly by securing the first portion 120 to the second portion 140 using the bolt 200 and nut 202 without any weight plates 150 or washers 204 included. Alternatively, the counterweight assembly 118 may include only washers 204 within the assembly of the first portion 120 and the second portion 140 when assembled with the bolt 200 and nut 202. Further, the assembly may include multiple washers 204, a plurality of weight plates 150, and both the first and second portions 120, 140 retained together by the bolt 200 and the nut 202. Various embodiments and permutations are possible among these exemplary configurations, and it is to be understood the possible configurations are not limited to those described herein.

An example assembly process of the counterweight assembly 118 may include the following steps: (1) the first portion 120 is placed on a stable surface with the top surface 160 and channel 166 facing vertically upward; (2) the second portion 140 is placed on top of the first portion 120 so the key 176 is inserted into the channel 166, such that the end walls 166*b* receive the end walls 176*b*; (3) the bolt 200 is placed through the bore 148 of the second portion 140; (4) the bolt 200 is threaded through the nut 202 pre-attached within the first portion 120 bore 128; and (5) the bolt 200 is tightened down using a hex key. The stable surface may include any number of surfaces, such as a table, a chair, a desk, a shelf, etc. The stable surface may alternatively include a book, a notepad, or even the lap of a user.

Another assembly process of the counterweight assembly 118 may include the following steps: (1) the first portion 120 is placed on a stable surface with the top surface 160 and channel facing vertically upward; (2) a single weight plate 150 is placed onto the first portion 120 so that the guide portions 196*b* of the key hole 196 are aligned and fit around the end walls 166*b* of the channel 166, so that the small apertures 194 are fit over the small posts 164*a* and 164*b*, while the large apertures 192 are fit over the large posts 162*a* and 162*b*; (3) step 2 is optionally repeated with a second weight plate 150; (4) the second portion 140 is placed on top of the at least one weight plate 150 and the first portion 120 such that the key 176 fits into the channel 166 with the end walls 176*b* placed into the end walls 166*b*; and (5) the bolt 200 is inserted through the bore 148 and threaded into the nut 202, which may be pre-attached to the first portion 120 within the bore 128, and tightened with a hex key.

Still another assembly process of the counterweight assembly 118 may include the following steps: (1) the first portion 120 is placed on a stable surface with the top surface 160 and channel facing vertically upward; (2) a single weight plate 150 is placed onto the first portion 120 so the guide portions 196*b* of the key hole 196 are aligned and fit around the end walls 166*b* of channel 166, so that the small apertures 194 are fit over the small posts 164*a* and 164*b*, while the large apertures 192 are fit over the large posts 162*a* and 162*b*; (3) step 2 is optionally repeated with a second weight plate 150; (4) one or more washers 204 are optionally placed into the chamber 180 within the channel 166; (5) the second portion 140 is placed on the at least one weight plate 150 and the first portion 120 such that the key 176 fits into the channel 166 with end walls 176*b* placed into the end walls 166*b*; and (6) the bolt 200 is inserted through the bore 148 and is threaded into the nut 202, which may be pre-attached to the first portion 120 within the bore 128, and tightened down with a hex key.

Other embodiments of the disclosure including all the possible different and various combinations of the individual features of each of the foregoing described embodiments and examples are specifically included herein.

Industrial Applicability

Numerous modifications to the present disclosure will be apparent to those skilled in the art of fastener assemblies in view of the foregoing description. Accordingly, this description is to be construed as illustrative only and is presented for the purpose of enabling those skilled in the art to make and use the same. The exclusive rights to all modifications which come within the scope of the appended claims are reserved.

What is claimed is:

1. A counterweight for a rotatable performance device, the counterweight comprising:

a first portion having a first post protruding from the first portion, the first portion comprising a channel;

a second portion that is configured to be attached to the first portion, the second portion comprising a key that is integral therewith and having a second post protruding from the second portion;

a groove formed on the first portion and the second portion;

at least one weight plate having at least one aperture; and a bore configured to receive a fastener, the bore extending through the first portion and the second portion, wherein the at least one aperture is configured to receive the first post, the second post, or both, respectively, wherein the groove is configured to receive a portion of a string, and wherein the key is configured to fit into the channel, thereby circumferentially aligning the first portion with the second portion.

2. The counterweight of claim 1, wherein the bore is centrally located on each of the first and second portions.

3. The counterweight of claim 1, wherein the groove extends along three sides of the first portion.

4. The counterweight of claim 1, wherein the groove extends along three sides of the second portion.

5. The counterweight of claim 1, wherein the groove of the first portion is configured to be aligned with the groove of the second portion.

6. The counterweight of claim 1, wherein the first portion further comprises:

a top surface, the channel extending through the top surface; and a plurality of first posts protruding from the top surface.

7. The counterweight of claim 1, wherein the second portion further comprises:

a bottom surface, the key extending from the bottom surface; and a plurality of second posts extending from the bottom surface.

8. The counterweight of claim 1, wherein the at least one weight plate is received between the first and second portions.

9. A counterweight for a rotatable performance device, the counterweight comprising:

a first portion having a first horizontal edge, a second horizontal edge, and at least one first post protruding from a top surface of the first portion;

a second portion having at least one second post protruding from a bottom surface of the second portion;

a groove formed on the first portion and the second portion;

at least one weight plate having at least one aperture; and a bore that extends through the first portion and the second portion, and is configured to receive a fastener, wherein the at least one weight plate is disposed between the first portion and the second portion, wherein the top surface of the first portion is spaced from the bottom surface of the second portion when the first portion and the second portion are secured to one another, wherein a face of the at least one first post is parallel with respect to the first horizontal edge and the second horizontal edge, and the at least one first post is offset with respect to the first horizontal edge, and wherein the at least one aperture is configured to receive the first post, the second post, or both, respectively.

10. The counterweight of claim 9, wherein the first portion further comprises:

a central wall extending from the top surface and defining a channel; and a chamber disposed within the channel.

11. The counterweight of claim 10, wherein the second portion further comprises:

a key extending from the bottom surface, wherein the key includes at least one end wall.

12. The counterweight of claim 11, wherein the channel of the first portion receives the key of the second portion in an assembled configuration.

13. The counterweight of claim 9, wherein a first groove formed on the first portion is configured to be aligned with a second groove formed on the second portion.

14. A counterweight for a rotatable performance device, the counterweight comprising:

a first portion including a first groove and a first post protruding from the first portion;

a second portion including a second groove that is arranged to be aligned with the first groove and a second post protruding from the second portion;

at least one weight plate having a recessed surface defining at least two apertures; and a bore that extends through the first portion, the second portion, and the at least one weight plate, the bore defining a central longitudinal axis, wherein the at least one weight plate is selectively engaged with the first portion and the second portion, wherein the at least two apertures are offset with respect to the central longitudinal axis, and wherein the at least two apertures are configured to receive the first post, the second post, or both, respectively.

15. The counterweight of claim 14, wherein the first groove and the second groove are configured to receive a string.

16. The counterweight of claim 14, wherein the bore is configured to receive a bolt and a nut.

17. The counterweight of claim 14, wherein the first portion further includes a first plurality of posts arranged on a top surface and the second portion further includes a second plurality of posts arranged on a bottom surface.

18. The counterweight of claim 17, wherein the recessed surface of the at least one weight plate is selectively configurable to contact either the first plurality of posts or the second plurality of posts, or both.

* * * * *